US006131010A

United States Patent [19]

Kume et al.

[11] Patent Number: 6,131,010

[45] **Date of Patent: *Oct. 10, 2000**

[54] ROTATABLE MEMBER HAVING ELASTIC LAYER AND FIXING APPARATUS HAVING SAID ROTATABLE MEMBER

[75] Inventors: Takao Kume, Susono; Norio Hashimoto, Odawara; Katsuhiko Nishimura, Yokohama; Koichi Hiroshima, Shizuoka-ken; Tooru Saitou, Mishima; Katsunori Takeuchi, Toride; Yozo Hotta, Susono; Masahiro Suzuki, Numazu, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/971,683

[22] Filed: Nov. 17, 1997

[30] Foreign Application Priority Data

| | | | |
|---|---|---|---|
| Nov. 15, 1996 | [JP] | Japan | 8-305287 |
| Jan. 31, 1997 | [JP] | Japan | 9-019532 |
| Feb. 10, 1997 | [JP] | Japan | 9-027076 |
| Oct. 1, 1997 | [JP] | Japan | 9-268666 |
| Nov. 14, 1997 | [JP] | Japan | 9-313450 |

[51] Int. Cl.[7] ..... G03G 15/20

[52] U.S. Cl. ..... 399/333; 399/330

[58] Field of Search ..... 399/320, 324, 399/328, 330, 331, 333

[56] References Cited

U.S. PATENT DOCUMENTS

| | | | |
|---|---|---|---|
| 4,814,819 | 3/1989 | Torino et al. . | |
| 5,173,736 | 12/1992 | Cherian | 399/330 |
| 5,289,246 | 2/1994 | Menjo | 399/333 |
| 5,493,380 | 2/1996 | Saitou et al. . | |
| 5,500,722 | 3/1996 | Jacobs | 399/328 |
| 5,504,567 | 4/1996 | Satoh et al. | 399/331 |
| 5,543,904 | 8/1996 | Kato et al. . | |
| 5,640,662 | 6/1997 | Sugimoto et al. | 399/333 |
| 5,682,576 | 10/1997 | Sakai et al. . | |
| 5,722,026 | 2/1998 | Goto et al. | 399/333 |

FOREIGN PATENT DOCUMENTS

| | | |
|---|---|---|
| 36-10231 | 7/1961 | Japan . |
| 54-080752 | 6/1979 | Japan . |
| 56-013945 | 2/1981 | Japan . |
| 59-053856 | 3/1984 | Japan . |
| 59-061842 | 4/1984 | Japan . |
| 7-271135 | 10/1995 | Japan . |

*Primary Examiner*—Sandra Brase

*Attorney, Agent, or Firm*—Fitzpatrick, Cella, Harper & Scinto

[57] ABSTRACT

A fixing apparatus for use in an image forming apparatus such as a copying apparatus or a laser beam printer is disclosed. The fixing apparatus has a heater, a rotatable member having the heater therein, and a pressing member forming a nip by coming into contact with the rotatable member. The rotatable member is provided with a core and an elastic layer formed on the core, and the elastic layer has a JIS-A Standard rubber hardness not more than 5°.

37 Claims, 21 Drawing Sheets

FIG. 3

RELATIONSHIP BETWEEN HARDNESS OF FIXING ROLLER AND EVALUATION OF IMAGE
AND
RELATIONSHIP BETWEEN HARDNESS OF FIXING ROLLER AND PLASTIC DEPORMATION OF ROLLER

| ROLLER SURFACE HARDNESS *1 | RUBBER HARDNESS *2 | FIXABILITY | GLOSS | PLASTIC DEFORMATION |
|---|---|---|---|---|
| 70° | 20° | × | HIGH | × |
| | 8° | × | HIGH | × |
| | 5° | × | HIGH | × |
| | 3° | × | HIGH | × |
| | 1° | × | LOW | × |
| | UNDER 1° *3 | × | LOW | × |
| 68° | 20° | × | HIGH | × |
| | 8° | × | HIGH | × |
| | 5° | × | LOW | × |
| | 3° | △ | LOW | × |
| | 1° | △ | LOW | × |
| | UNDER 1° *3 | △ | LOW | × |
| 65° | 20° | × | HIGH | × |
| | 8° | △ | HIGH | × |
| | 5° | ○ | LOW | ○ |
| | 3° | ○ | LOW | ○ |
| | 1° | ○ | LOW | ○ |
| | UNDER 1° *3 | ○ | LOW | ○ |
| 63° | 20° | △ | HIGH | △ |
| | 8° | △ | HIGH | △ |
| | 5° | ○ | LOW | ○ |
| | 3° | ○ | LOW | ○ |
| | 1° | ○ | LOW | ○ |
| | UNDER 1° *3 | ○ | LOW | ○ |

*1 : ASKER C; *2 : JIS-A STANDARD; *3 : IN ASKER C

FIXABILITY :

○ : GOOD

△ : "TONER BLISTER" AT SWEEP-UP PORTION

× : "TONER BLISTER" OVER ENTIRE SURFACE OR COLD OFFSET PRODUCED

PLASTIC DEFORMATION :

○ : NONE (NO ABNORMAL SOUND; NO IMAGE DEFECT)

△ : ABNORMAL SOUND; NO IMAGE DEFECT

× : ABNORMAL SOUND, IMAGE DEFECT PRODUCED

TEXT + GRAPH $$SF\ 1 = \frac{(MXLNG)^2}{AREA} \times \frac{\pi}{4} \times 100$$

$$SF\ 2 = \frac{(PERI)^2}{AREA} \times \frac{1}{4\pi} \times 100$$

FIG. 12

| RUBBER HARDNESS IN JIS-A STANDARD | FIXING/ PRESSING ROLLER DIAMETER | ROLLER THICKNESS : FIXING/ PRESSING (mm) | NIP WIDTH (mm) | FIXABILITY |
|---|---|---|---|---|
| 15° PRESSING FORCE 60kgf | 60.0 | 3t / 2t | 10.5～11.5 | ○ |
| | | 2.5t / 1.5t | 9.0～10.0 | ○ |
| | 46.0 | 3t / 2t | 7.5～8.5 | × |
| | | 2.5t / 1.5t | 7.0～8.0 | × |
| | 40.0 | 3t / 2t | 6.5～7.5 | × |
| | | 2.5t / 1.5t | 6.0～7.0 | × |
| 8° PRESSING FORCE 60kgf | 60.0 | 3t / 2t | 11.0～12.0 | ○ |
| | | 2.5t / 1.5t | 10.5～11.5 | ○ |
| | 46.0 | 3t / 2t | 8.0～9.0 | △ |
| | | 2.5t / 1.5t | 7.5～8.5 | × |
| | 40.0 | 3t / 2t | 7.0～8.0 | × |
| | | 2.5t / 1.5t | 6.5～7.5 | × |
| 5° PRESSING FORCE 50kgf | 60.0 | 3t / 2t | 11.5～12.5 | ○ |
| | | 2.5t / 1.5t | 10.5～11.5 | ○ |
| | 46.0 | 3t / 2t | 8.0～9.0 | ○ |
| | | 2.5t / 1.5t | 7.5～8.5 | ○ |
| | 40.0 | 3t / 2t | 7.5～8.5 | △ |
| | | 2.5t / 1.5t | 7.0～8.0 | △ |
| 1° PRESSING FORCE 50kgf | 60.0 | 3t / 2t | 12.0～13.0 | ○ |
| | | 2.5t / 1.5t | 11.0～12.0 | ○ |
| | 46.0 | 3t / 2t | 8.5～9.5 | ○ |
| | | 2.5t / 1.5t | 8.0～9.0 | ○ |
| | 40.0 | 3t / 2t | 7.5～8.5 | △ |
| | | 2.5t / 1.5t | 7.0～8.0 | △ |

FIG. 13

| RUBBER HARDNESS IN JIS-A STANDARD | FIXING/ PRESSING ROLLER DIAMETER | ROLLER THICKNESS : FIXING/ PRESSING (mm) | NIP WIDTH (mm) | FIXABILITY | WARMING-UP TIME (sec) |
|---|---|---|---|---|---|
| 3° PRESSING FORCE 50kgf | 46.0 | 3.0t / 3.0t | 10.0～11.0 | ○ | 330～340 |
| | | 3.0t / 2.5t | 9.5～10.5 | ○ | 310～320 |
| | | 3.0t / 2.0t | 9.0～10.0 | ○ | 290～300 |
| | | 2.8t / 2.0t | 8.5～9.5 | ○ | 290～300 |
| | | 2.5t / 1.5t | 8.0～9.0 | ○ | 270～280 |
| | | 2.3t / 1.7t | 8.0～9.0 | ○ | 260～270 |
| | | 2.1t / 1.9t | 8.0～9.0 | ○ | 260～270 |
| | | 2.0t / 2.0t | 8.0～9.0 | ○ | 260～270 |
| | | 2.0t / 1.7t | 7.5～8.5 | △ | 230～240 |
| | | 1.8t / 1.5t | 7.0～8.0 | × | 240～250 |

FIG. 16

| RUBBER HARDNESS IN JIS-A STANDARD | FIXING/ PRESSING ROLLER DIAMETER | ROLLER THICKNESS : FIXING/ PRESSING (mm) | THICKNESS RATIO | OHT WINDING | BOTH-SIDE INTERMEDIATE IMAGE TRANSFER MEDIUM WINDING |
|---|---|---|---|---|---|
| 1° PRESSING FORCE 50kgf | 46.0 | 2.5t / 1.5t | 0.60 | × | × |
| | | 2.4t / 1.6t | 0.66 | × | × |
| | | 2.3t / 1.7t | 0.74 | ○ | ○ |
| | | 2.1t / 1.9t | 0.90 | ○ | ○ |
| | | 2.0t / 2.0t | 1.00 | ○ | ○ |

FIG. 17

| RUBBER HARDNESS IN JIS-A STANDARD | FIXING/ PRESSING ROLLER DIAMETER | TOTAL THICKNESS (mm) | ROLLER THICKNESS : FIXING/ PRESSING (mm) | THICKNESS RATIO | NIP WIDTH (mm) | FIXABILITY | OHT WINDING |
|---|---|---|---|---|---|---|---|
| 3° PRESSING FORCE 40kgf | 40.0 | 4t | 2.5t / 1.5t | 0.60 | 8.0～9.0 | ○ | × |
| | | | 2.3t / 1.7t | 0.74 | | ○ | ○ |
| | | | 2.1t / 1.9t | 0.90 | | ○ | ○ |
| | | 3.5t | 2.3t / 1.2t | 0.52 | 7.0～8.0 | ○ | × |
| | | | 2.0t / 1.5t | 0.90 | | ○ | ○ |
| | | | 1.8t / 1.7t | 0.94 | | ○ | ○ |
| | | 3.0t | 2.0t / 1.0t | 0.56 | 6.0～7.0 | △ | × |
| | | | 1.8t / 1.2t | 0.66 | | △ | × |
| | | | 1.6t / 1.4t | 0.88 | | △ | ○ |

ROTATABLE MEMBER HAVING ELASTIC LAYER AND FIXING APPARATUS HAVING SAID ROTATABLE MEMBER

BACKGROUND OF THE INVENTION

1. Field of the Invention

The present invention relates to a fixing apparatus to be incorporated into a copying machine, a laser beam printer or the like.

2. Description of the Related Art

A conventional fixing apparatus provided with a fixing roller and a pressing roller fixes an unfixed developer image onto a recording medium by holding a recording medium that has a multiple-color/multiple-layer or monochrome unfixed developer image on it and transferring the recording medium through their pressure-contact portion between its fixing roller and pressing roller. FIG. 21 is a schematic sectional view of a heat roller fixing apparatus that is used as a toner image fixing apparatus in a color image forming apparatus such as an electrophotographic apparatus, an example of such a conventional fixing apparatus.

In FIG. 21, a fixing roller is provided with a silicone rubber layer on an aluminum core shaft. The silicone rubber is of the RTV or LTV type and has an elasticity as represented by a JIS-A Standard rubber hardness within a range of from 20° to 25°. A larger thickness of the silicone rubber leads to a lower surface hardness of the roller, and hence to a higher fixability. When the thickness becomes excessively larger, in contrast, heat conduction requiring a longer period of time leads to a longer warm-up time, or makes it impossible to achieve uniform fixing.

On the other hand, the pressing roller suffices to have a smaller elasticity than that of the fixing roller: provision of an HTV or fluorine rubber layer on the aluminum core shaft will do, or a PFA or PTFE may be coated on the surface.

When sufficient heat and pressing force are applied to the roller with a view to obtaining an image of a high fixability by the use of this conventional fixing apparatus, the surface of a toner image becomes smoother and gloss of the image is improved.

However, when an image formed on a copy paper of a low gloss has a high gloss, there occurs a large difference in gloss between the non-image portion and the image portion. This gives a feeling of mismatch to a viewer. Particularly, in the case of a monochromatic character image in a business use, the character itself has a high gloss, making it difficult to read the character under the effect of reflection.

It is therefore proposed to reduce gloss by decreasing the fixing temperature or reducing the pressing force to obtain a low-gloss image. However, on the other hand, a lower fixing temperature leads to more difficult fixing of toner, and particularly in the case that full color or four color toners are applied, it may become impossible to achieve fixing.

In the conventional fixing apparatus, therefore, it is difficult to obtain an image having a low gloss and a high fixability.

With a conventional roller, if the fixing roller and the pressing roller are left in pressure contact with the heater turned off, i.e., not heated by the heater for a long period of time (for a night, for example), the roller collapsed at the pressure-contact portion as shown in FIG. 21 would harden, and this deflection would not be eliminated even by heating again with the heater. This causes abnormal sound during rotation of the rollers. A larger deflection leads to a problem of occurrence of a defective image caused by irregular rotation.

SUMMARY OF THE INVENTION

An object of the present invention is to provide a fixing roller and a fixing apparatus requiring a short warm-up period.

Another object of the invention is to provide a fixing apparatus and a fixing roller which satisfy a certain fixability and give a low gloss.

Further another object of the invention is to provide a fixing apparatus and a fixing roller requiring a short warm-up period while satisfying fixability and a low gloss.

Further another object of the invention is to provide a fixing roller free from plastic deformation.

In addition, the invention has an object to provide a fixing apparatus comprising a heating member, a rotatable member having the heating member in the interior thereof and heating an unfixed toner on a recording medium, and a pressing member forming a nip with the rotatable member to hold a recording medium in between, wherein the rotatable member comprises a core, an elastic layer provided on the core, and a thin surface layer provided on the elastic layer, and the elastic layer has a JIS-A Standard rubber hardness not more than 5 degrees.

Furthermore, the invention has an object to provide a fixing apparatus comprising a heating member, a rotatable member having the heating member in the interior thereof and heating an unfixed toner on a recording medium, and a pressing member forming a nip with the rotatable member to hold the recording medium in between, wherein the rotatable member comprises a core and a surface elastic layer provided on the core, and the surface elastic layer has a JIS-A Standard rubber hardness not more than 5 degrees.

Other objects of the invention will become apparent from the following description.

BRIEF DESCRIPTION OF THE DRAWINGS

FIG. 3 illustrates the relationship between hardness of the fixing roller and evaluation of an image and the relationship between hardness of the fixing roller and plastic deformation of a roller;

FIG. 12 illustrates the nip width and fixability with various values of roller hardness, diameter and rubber member thickness of the fixing/pressing rollers in the third embodiment of the invention;

FIG. 13 illustrates the nip width, fixability and warm-up time with various values of thickness of the rubber member of the fixing/pressing rollers in the third embodiment of the invention;

FIG. 16 illustrates the thickness ratio, OHT winding and two-side intermediate copy winding with various values of thickness of a rubber member of the fixing/pressing rollers in the fourth embodiment of the invention;

FIG. 17 illustrates the thickness ratio, nip width, fixability and OHT winding with various values of thickness and total thickness of the rubber member of the fixing/pressing rollers in a fifth embodiment of the invention;

DESCRIPTION OF THE PREFERRED EMBODIMENTS

Now, embodiments of the invention will be described below with reference to the drawings.

First Embodiment

Figure 1:
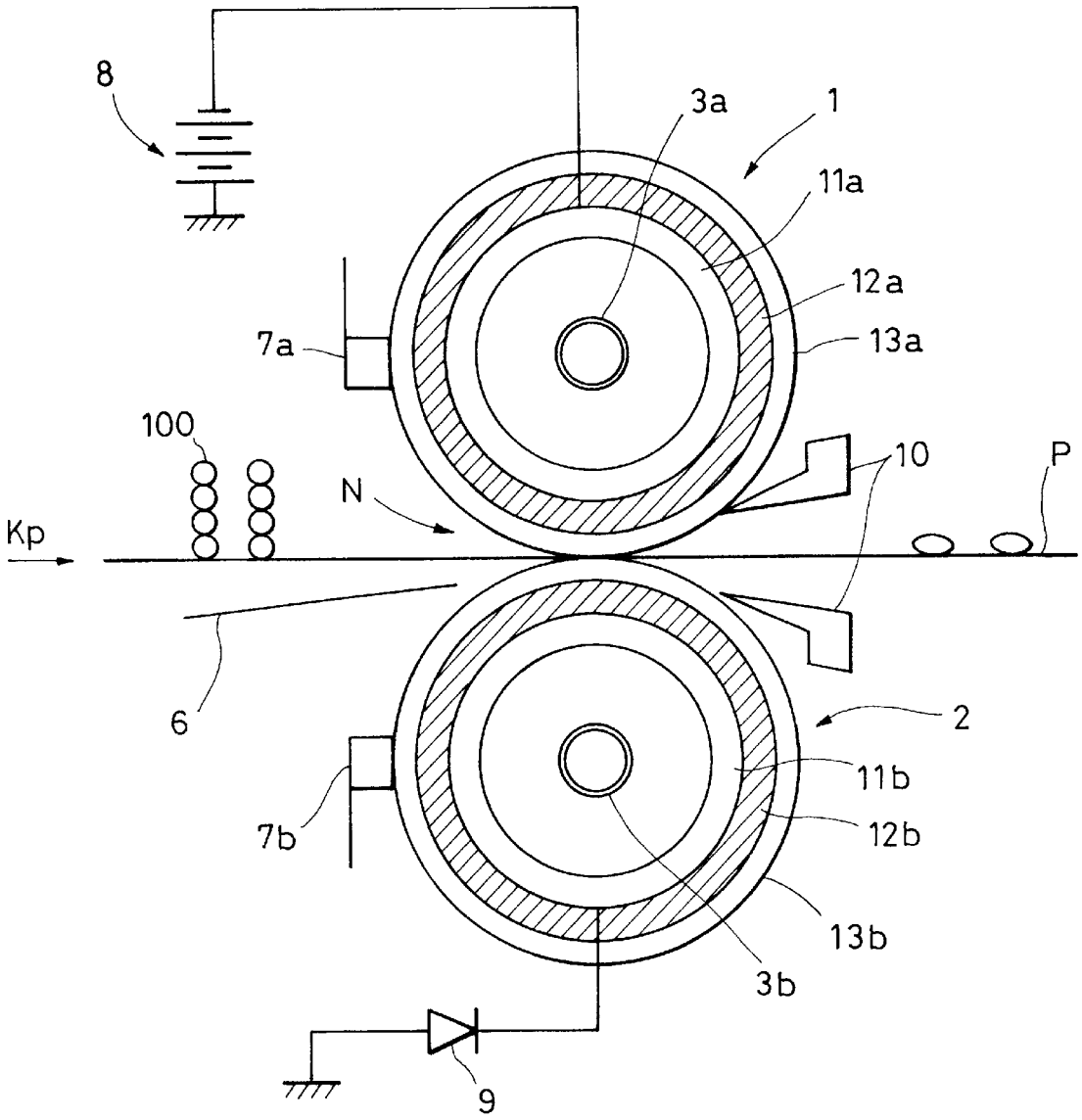
FIG. 1 is a longitudinal sectional view illustrating a schematic configuration of a fixing apparatus of a first embodiment of the invention.

The configuration of a fixing apparatus of a first embodiment of the invention is illustrated in FIG. 1. In the fixing apparatus shown in FIG. 1, a fixing roller (upper roller) 1 is arranged above, and a pressing roller (lower roller) 2 is arranged below, and a fixing nip portion N is formed by bringing these rollers 1 and 2 into pressure contact. The foregoing fixing roller 1 and the pressing roller 2 are not strictly different from each other in construction. In the following description, however, the roller in contact with an unfixed toner image on the recording medium P is referred to as the fixing roller 1, and the roller in pressure contact with the fixing roller 1, as the pressing roller 2. The two rollers are collectively called the fixing/pressing rollers. Details of the fixing/pressing rollers will be described later.

Heaters as heating members 3*a* and 3*b* are arranged in the fixing/pressing rollers, respectively, and thermistors 7*a* and 7*b* for temperature adjustment are arranged in contact with the surfaces thereof. Temperature of the fixing/pressing rollers is controlled by the thermistors 7*a* and 7*b*. Further, voltage of about −1 kV is applied to the core 11*a* by a power source 8 to prevent electrostatic offset on the fixing roller 1 side. On the other hand, a core 11*b* on the pressing roller 2 side is potential-controlled by a diode 9.

A recording medium P on which a toner image has been copied enters in the arrow Kp direction the fixing nip portion N. The recording medium P is heated and pressed by the fixing/pressing rollers at the fixing nip portion N, so that an unfixed toner image on the surface is melted and fixed.

An elastic layer 12*a* of the fixing roller 1 has a larger thickness than the toner layer on the recording medium. This is the elastic layer 12*a* has a thickness of at least several tens of μm with a view to following the multiple toner thickness (several to several tens of μm) of monochrome to four colors of a color image. This elastic layer 12*a*, with a low elasticity, causes a decrease in resolution as a result of unfixing of a recess in the toner layer or collapse of toner. The elastic layer 12*a* should therefore be made preferably of RTV or LTV-type methyl-based or methylvinyl-based liquid silicone rubber because of the elasticity. A methylphenyl-based silicone rubber may also be used.

The fixing roller 1 of this embodiment has an LTV-type elastic layer 12*a* made of dimethyl silicone rubber having a JIS-A rubber hardness (a hardness as measured by means of a JIS-A hardness meter on a test piece formed into a shape specified in the JIS Standard; hereinafter referred to as "rubber hardness") of 1° or 5° provided on an aluminum core 11*a*, and a release layer 13*a* comprising a 50 μm PFA tube layer formed thereon. The roller outer shape is formed into a diameter of 46 mm. The fixing roller has a surface hardness (a surface hardness of the roller peripheral surface under a total load of 1 kg of an Asker C hardness meter made by Kobunshi Keiki Co.; hereinafter referred to as "surface hardness") of 65° for a rubber hardness (JIS-A Standard) of 5°, and 60° for a rubber hardness (JIS-A Standard) of 1°.

It is possible to keep the shape of toner which is a developer on the surface, without smoothening the toner layer surface by using a JIS-A Standard rubber hardness of rubber not more than 5° and a roller surface hardness not more than 65° (Asker C), thereby achieving a low gloss without impairing fixability.

If, in place of a soft roller rubber layer having a surface hardness of, for example, not more than 65° (Asker C) to ensure a sufficient fixability, the rubber layer is made of a conventional rubber (having a JIS-A rubber hardness within a range of from 20 to 25°), the rubber layer would be too thick to obtain a necessary elasticity, resulting in a poorer heat conductivity of the roller.

If rubber is soft, however, the rubber layer thickness can be smaller. For example, when rubber having a rubber hardness (JIS-A Standard) of 5° is used for a roller rubber layer having a surface hardness of 65° (Asker C), the rubber layer would have a thickness of 2.5 mm, and when rubber having a rubber hardness of 1° (JIS-A Standard) is used, the rubber layer would be thinner than 2.5 mm. According as the rubber of the rubber layer is softer, therefore, the thickness of the rubber layer can be smaller. It is therefore possible to reduce the roller rubber layer sufficiently (for example, up to 2.5 mm for a surface hardness of 65° (Asker C)), thereby achieving a satisfactory heat conductivity of the roller, by using a rubber having a rubber hardness (JIS-AA Standard) not more than 5°, thus permitting reduction of the warm-up time. Possibility of inhibiting the heat source temperature to a low level allows prevention of deterioration of the rubber. Furthermore, it is also possible to prevent temperature increase at ends of the rollers when continuing threading of small-sized sheets of paper such as postcard. The resultant higher heat response permits reduction of the difference in temperature of the roller surface between start and end of paper threading, thus making it possible to fix an image within the size of paper into a uniformly low gloss.

However, the thickness of the elastic layer should preferably be larger than at least the toner layer, as described above. The reason is that this permits the roller surface to follow the toner layer surface and prevention of unfixing the toner in recesses of the toner layer. When fixing a color image onto an OHT which is a recording medium permitting transmission of light, it is possible to wrap the toner layer with the roller surface to achieve a toner image allowing transmission of light.

On the other hand, the elastic layer 12*b* of the pressing roller 2 may have an elasticity smaller than that of the elastic layer 12*a* of the fixing roller 1. The layer may be formed by providing an HTV or a fluorine rubber on the aluminum core shaft. One having substantially the same configuration as the fixing roller may of course be used.

The pressing roller 2 of this embodiment has the LTV-type elastic layer 12*b* of dimethyl silicone rubber having a rubber hardness (JIS-A Standard) of 1° or 5° provided on the aluminum core 11*b* in a thickness of 1.5 mm, and a release layer 13*b* comprising a 50-μm PFA tube layer thereon to form into a roller outside diameter of 46 mm. The pressing roller has a surface hardness of 70° (Asker C) for a rubber hardness (JIS-A Standard) of 5°. A methyl-phenyl-based silicone rubber is also applicable as the rubber for the pressing roller 2.

In this configuration, the developer on the surface of the developer layer can keep the shape thereof even at a high fixing temperature, i.e., concaves and convexes corresponding to the shape of the developer are formed, and the developer at the bottom of the developer layer on the recording medium side melts, giving a sufficient adhesion with the paper, thus making it possible to obtain a satisfactory fixability while inhibiting gloss.

The pressing roller in this embodiment gives a pressing force of 40 kgf. The present inventors obtained findings, as described above, that the gloss of an image shows almost no change even under a pressing force varying within a range of from 30 kgf to 60 kgf by using a surface hardness of the fixing roller not more than 65° (Asker C), a surface hardness of the pressing roller not more than 75° (Asker C), and a JIS-A Standard rubber hardness not more than 5° for the elastic layers of the fixing roller and the pressing roller. Under various pressing forces, as described above, the developer of the developer layer on the recording medium side melts and adheres to the recording medium, the developer layer surface keeping the shape of the concaves and convexes, thus making it possible to obtain an image with a satisfactory fixability having a low gloss.

In FIG. 1, 100 is a polymer toner and P is a recording medium onto which an unfixed developer image is to be fixed. In this apparatus, the fixing temperature is 180° C. with a ripple within ±3° C., and the roller circumferential speed is within a range of from 110 to 120 mm/sec.

Figure 21:
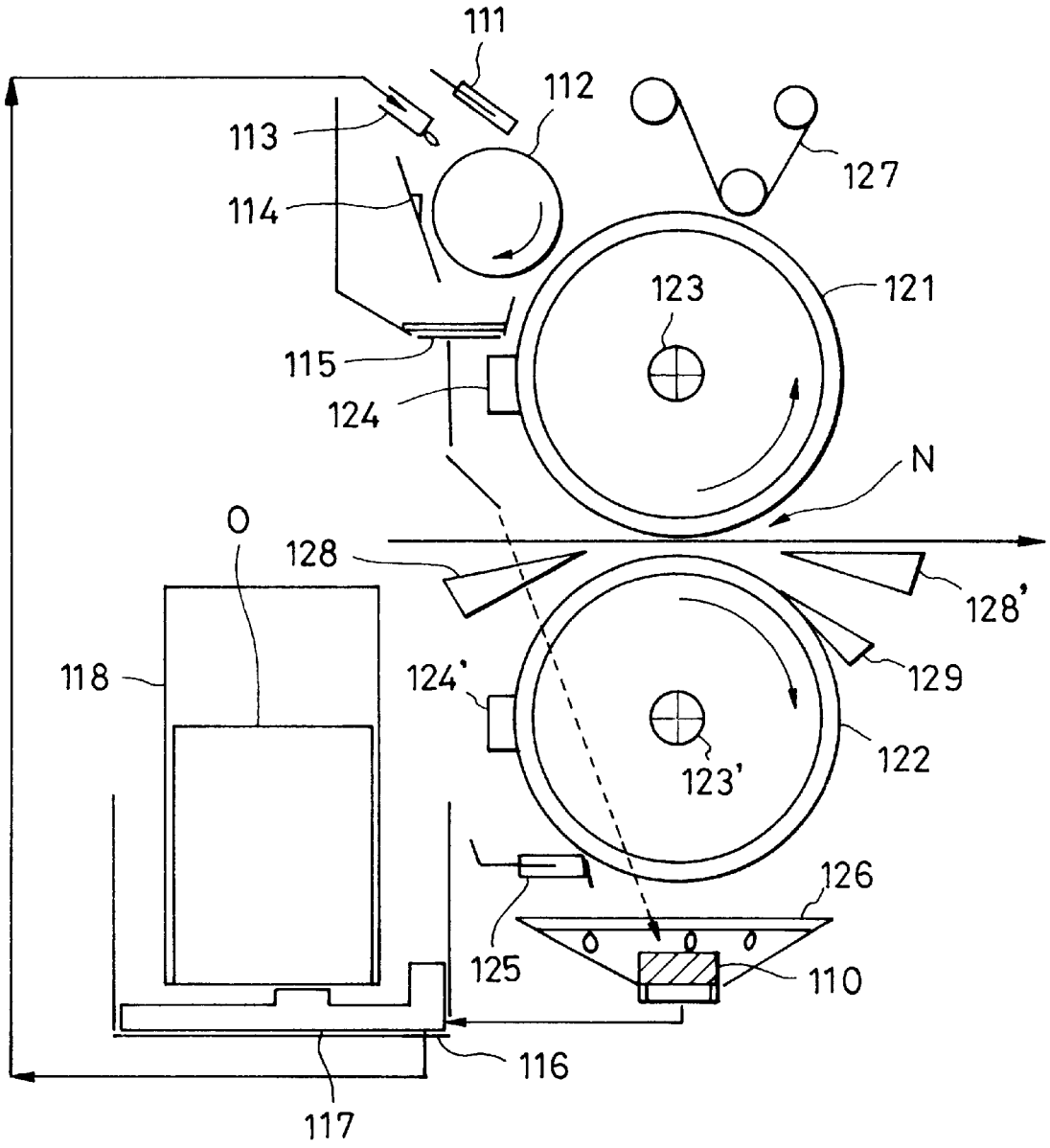
FIG. 21 illustrates a configuration of the conventional fixing apparatus.

In this embodiment, the apparatus does not have an oil coating section such as the oil coating roller 112 of the fixing apparatus shown in FIG. 21. A uniform gloss free from oil irregularities is therefore available.

An object of the present invention is to achieve a low gloss of each color as described above. The term "gloss" as used in the invention is defined substantially by the method 2 of JIS-Z 8741 applicable when measuring the mirror gloss (hereinafter simply referred to as "gloss").

Figure 2:
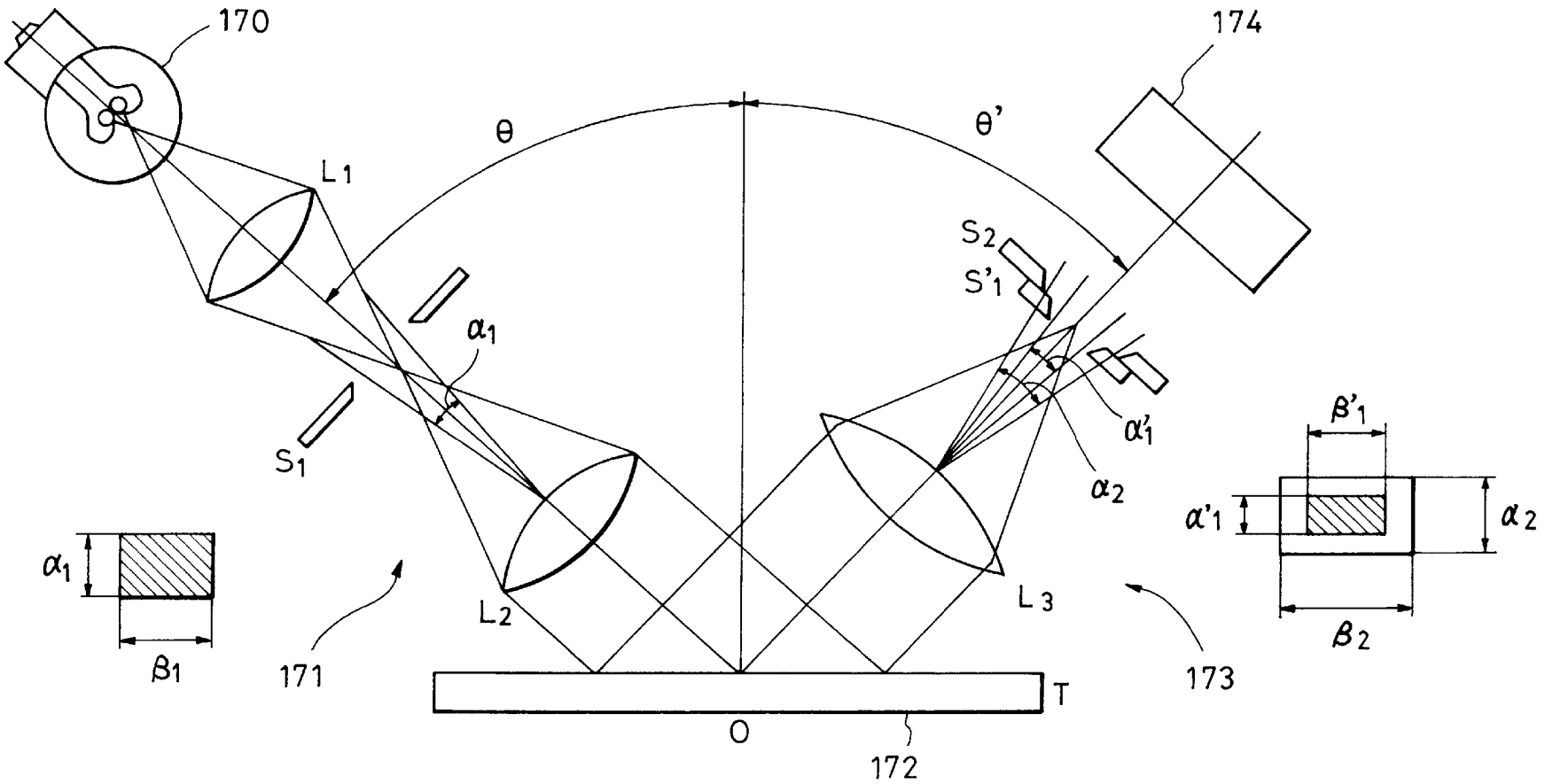
FIG. 2 is a conceptual diagram of a gloss measuring apparatus used for measuring gloss.

FIG. 2 is a conceptual view of a measuring apparatus for measuring gloss. Measuring of gloss comprises the steps of irradiating a light onto a sample 172 from a light source 170 through an optical system 171, and causing a photodetector 174 to receive a reflected light from the sample 172 via another optical system 173. In FIG. 2, $S_1$, $S_1'$ and $S_2$ are slits; α1 is an opening angle of a light image; β1 is a opening angle within a vertical plane; α2 is an opening angle of the photodetector; and β2 is an opening angle within a vertical plane.

On the assumption that a mirror-reflected luminous flux from the sample 72 surface is ϕ relative to a prescribed incident angle θ shown in FIG. 2, and a reflected luminous flux from the reference surface is ϕS, then the gloss G can be expressed by the following formula:

$$G=(\phi/\phi S)\times(\text{gloss of the reference surface used})$$

where, the reference surface used herein has a gloss of 100.0. The gloss would therefore be represented by a value of up to 100.

The gloss measuring apparatus used in the invention is a PG-3D (incident angle θ=75°) made by Nihon Denshoku Kogyo Co., and a black gloss plate having a gloss of 96.9 is employed as a reference surface. The measuring method comprises printing out nine batch images having a size of 3.0 mm×3.0 mm onto a 4024 paper (weighing 75 g; letter size) made by Xerox Co., and adopting an average value over nine resultant values.

The gloss of an image portion is an expression of the fixing state of a toner image formed on an image supporting medium. Gloss may therefore vary with viscosity and elasticity properties of the toner, mechanical configuration of the fixing process, and fixing conditions.

The toner 100 used in the invention is a polymerization-based toner prepared by previously adding a wax, paraffin or the like having a melting viscosity and a molecular weight smaller than those of the toner mother resin as a release agent. An oilless process is thus achieved in which a high color mixing property is achievable, and upon fixing, the wax, comprised inside the toner, leaches out from the toner under the effect of heat, thus promoting the releasing effect of the heat roller fixing apparatus. Details of the polymer toner 100 will be described later, so that a detailed description thereof is omitted here.

With the use of this developer, values of gloss and "toner blister" (fixability) were compared with various values of the surface hardness of the fixing roller and the rubber hardness of silicone rubber forming the elastic layer. The term "toner blister" is used here to mean such a state that part of a toner layer has floated apart from the surface of a recording medium as if it blisters. The result of use of a conventional roller having an elastic layer of a silicone rubber having a hardness of 20° (JIS-A Standard) was compared with that of the fixing apparatus of the invention.

Evaluation of an image was carried out by comparatively measuring gloss and fixability of solid color images of yellow (Y), magenta (M), cyan (C), red (R), green (G), blue (B) and black (Bk) (red, green and blue are respectively formed with two colors) at a fixing temperature of 180° C.

From among the results of evaluation, those regarding magenta tending to most easily cause "toner blister" are illustrated in FIG. 3. In FIG. 3, the lowest rubber hardness is up to 1° in JIS-A Standard, and 7° in Asker C.

Gloss was measured by assuming M/S=1.5 in a formula of the quantity of adhering toner M/S [mg/cm$^2$] (weight of adhering toner per unit area of the recording medium). This corresponds to an adhering quantity of a full-color image formed by four kinds of toner. (For a color having an offset, measuring was carried out on a portion not containing an offset.)

The pressing roller has a surface hardness of 75° (Asker C), and the elastic layer thereof has a rubber hardness of 5° (JIS-A Standard).

In FIG. 3, the term "toner blister" means a phenomenon in which many air bubbles are produced between the recording medium and the developer layer, and as a result, the toner layer is in a state of blister, and part thereof peels off from the recording medium in a floating state. While analysis is underway to clarify the mechanism of production of air bubbles, the present inventors conjecture that insufficient melting of the developer on the recording medium side reduces adhesion with the recording medium, thus causing production of air bubbles. In FIG. 3, a roller not suffering occurrence of "toner blister" is represented by a "○", a roller containing "toner blister" occurring at sweep-up portion is represented by a "Δ"; and a roller containing "toner blister" over the entire image, or suffering production of cold offset is represented by a "x".

Figure 4:
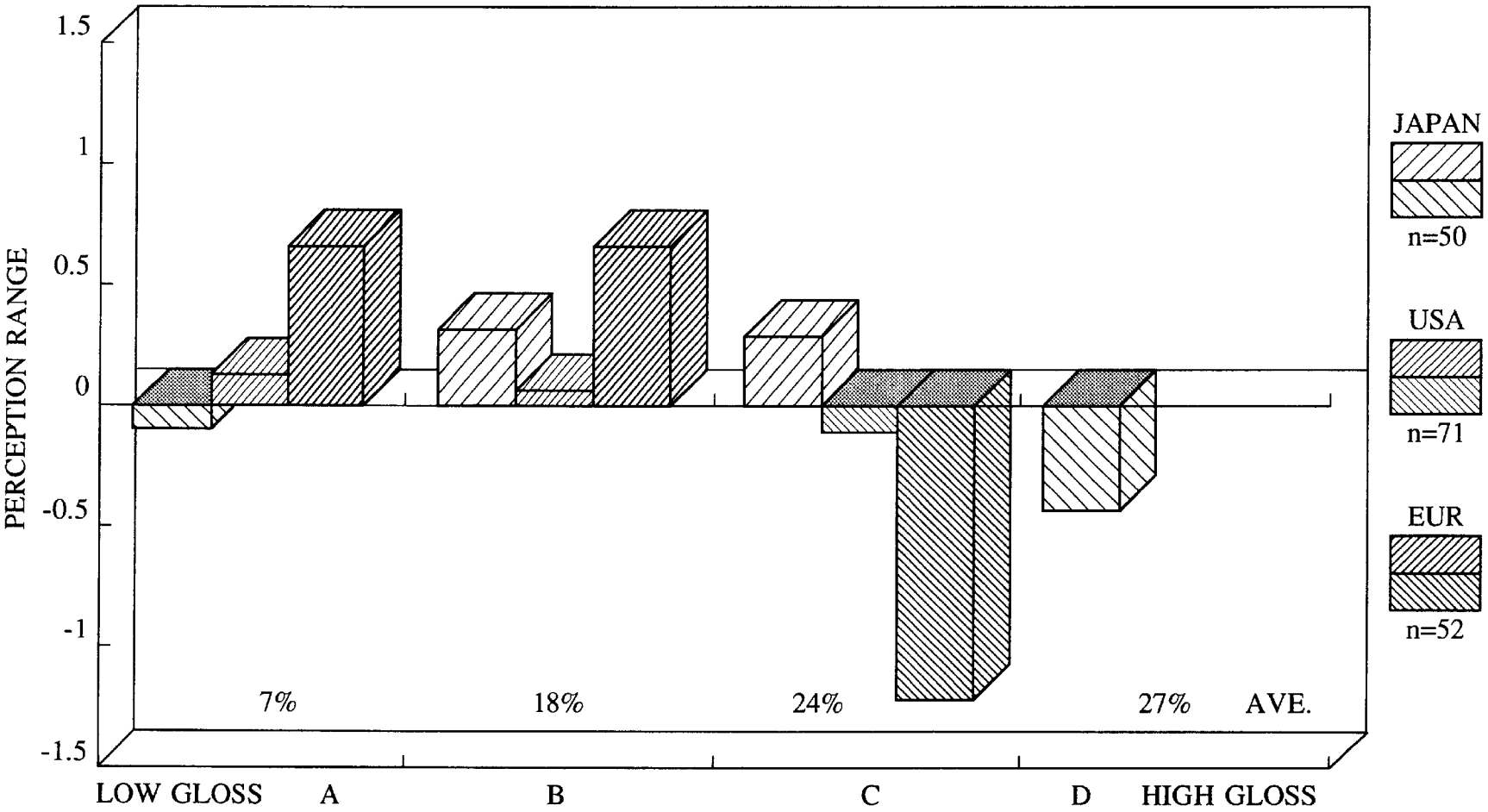
FIG. 4 illustrates the result of a gloss monitor test.

The present inventors carried out a gloss monitor test to investigate a degree of gloss to make the image applicable to business uses. The monitoring test comprised setting text and graph samples at degrees of gloss as shown in FIG. 4, and determining a mark of good or poor for each sample. The degree of gloss is represented by an average over several points on the sample. Measurement of gloss was made by means of a measuring apparatus made by Nihon Denshoku Co. with 75°. The result suggests that a degree of gloss within a range of from 7 to 18% is preferable, and a degree of gloss of over 24% does not give a good impression. In FIG. 4, therefore, a degree less than 24% is marked "low", and a degree not less than 24% is marked "high".

As is clear from FIG. 3, in order to inhibit the degree of gloss while maintaining a satisfactory fixability, the roller surface hardness should preferably be not more than 65° (Asker C), and the elastic layer should preferably have a rubber hardness not more than 5° (JIS-A Standard).

More preferably, the JIS-A rubber hardness should be up to 1° (not less than 7° in Asker C). By using this rubber, it is possible to obtain an image of a very good impression with a degree of gloss not exceeding 24% even with a maximum adhering quantity of M/S=1.8 of a full-color image.

As described above, by using a rubber hardness not more than 5° (JIS-A Standard) for the elastic layer of the roller, it has become possible to use a high fixing temperature while inhibiting gloss, and obtain a low-gloss image having a satisfactory fixability.

Even under an increased pressing force, it is possible to obtain an image with a low gloss and a satisfactory fixability.

A low-gloss image with a satisfactory fixability is available also in a system using a sharp-melting non-magnetic toner having a low melting point and a low melting viscosity and silicone oil as a release agent.

As described above, a low degree of gloss was available for a full-color image as well as a monochromatic image and it was possible to reduce a difference in the degree of gloss between the non-image portion and the image portion, and to prevent problems such as difficult reading of characters caused by reflection resulting from a high gloss. This provides a user with a feeling of easiness psychologically. Fatigue is not suffered from even after reading a plurality of sheets, and thus there is available a full-color image having a stable degree of gloss.

While the comparison illustrated in FIG. 3 covers a pressing roller having a surface hardness of 75° (Asker C), it suffices for the pressing roller to have a surface hardness not more than 75° (Asker C). The rubber hardness of the elastic layer of the pressing roller should preferably be not more than 5° (JIS-A Standard). The same hardness as that of the fixing roller can give the same effect.

The present inventors examined plastic deformation (permanent strain) of the roller. The result is illustrated in FIG. 3.

Plastic deformation was studied by holding the roller for two weeks in a state in which a heater serving as a heat source was turned off, i.e., at the room temperature (20° C. to 25° C.). A roller not suffering plastic deformation, i.e., free from abnormal sound or an image defect was marked "○"; a roller producing abnormal sound but free from an image defect was marked "Δ"; and a roller suffering from abnormal sound and an image defect was marked "x".

As is clear from FIG. 3, no plastic deformation (permanent strain) occurs even when holding the roller for a long period of time if the roller has a surface hardness not more than 65° (Asker C) and the elastic layer has a rubber hardness not more than 5° (JIS-A Standard). By using such a roller, therefore, it is possible to prevent abnormal sound or an image defect resulting from plastic deformation of the roller. The inventors conjecture that, as a result of use of a rubber having a rubber hardness not more than 5° (JIS-A Standard) for the elastic layer of the roller, the limit of elasticity of the roller becomes larger than in the use of a conventional rubber (a rubber having a JIS-A Standard rubber hardness within a range of from 20° to 25°).

While there is a single elastic layer in this embodiment, the elastic layer may comprise a plurality of layers only if the elastic layer has a JIS-A Standard hardness not more than 5°.

The release layer is not limited to a PFA tube, but it may be a tube comprising any other fluororesin or a coating layer, only if a sufficient releasability relative to the toner is available.

The release layer in this embodiment has a thickness of 50 μm. The thickness of the release layer should preferably be not less than 10 μm and not more than 100 μm so as to maintain satisfactory durability and heat conductivity and to follow deformation of the elastic layer inside.

Second Embodiment

Figure 5:
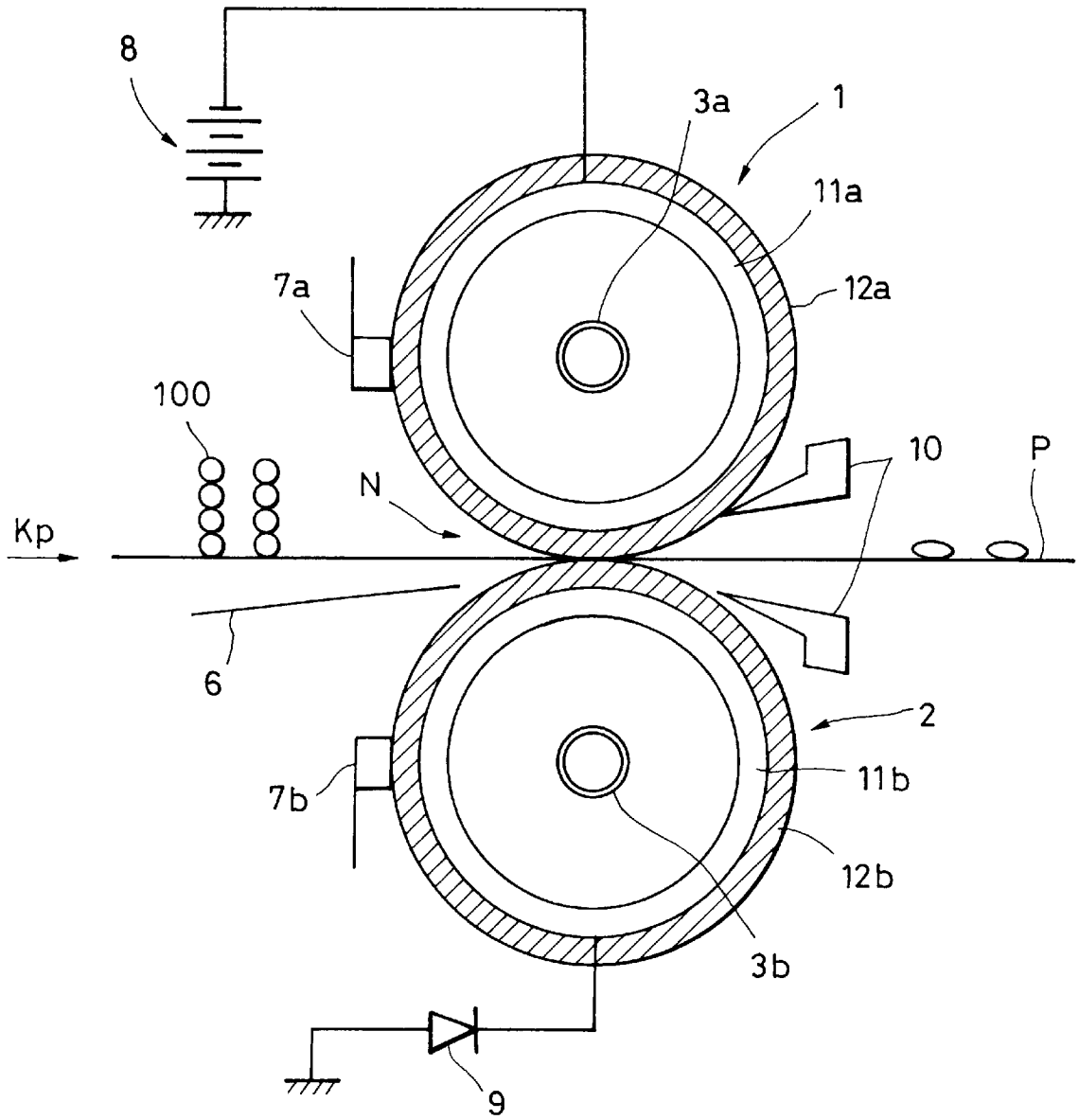
FIG. 5 is a longitudinal sectional view illustrating a schematic configuration of a fixing apparatus of a second embodiment of the invention.

FIG. 5 illustrates a schematic configuration of a fixing apparatus of a second embodiment of the invention. The same reference numerals as in FIG. 1 represent the same components.

The second embodiment differs from the first embodiment in that elastic layers 12*a* and 12*b* having a rubber hardness not more than 5° (JIS-A Standard) provided on core shafts 11*a* and 11*b* of the fixing roller 1 and the pressing roller 2 serve as surface layers.

By adopting this configuration, the thickness of the elastic layer can be smaller than in the first embodiment, leading to further improved heat conductivity and thermal response.

Now, third to fifth embodiments of the invention will be described with the thickness of the rubber layer and fixability of the roller in view.

Third Embodiment

Figure 6:
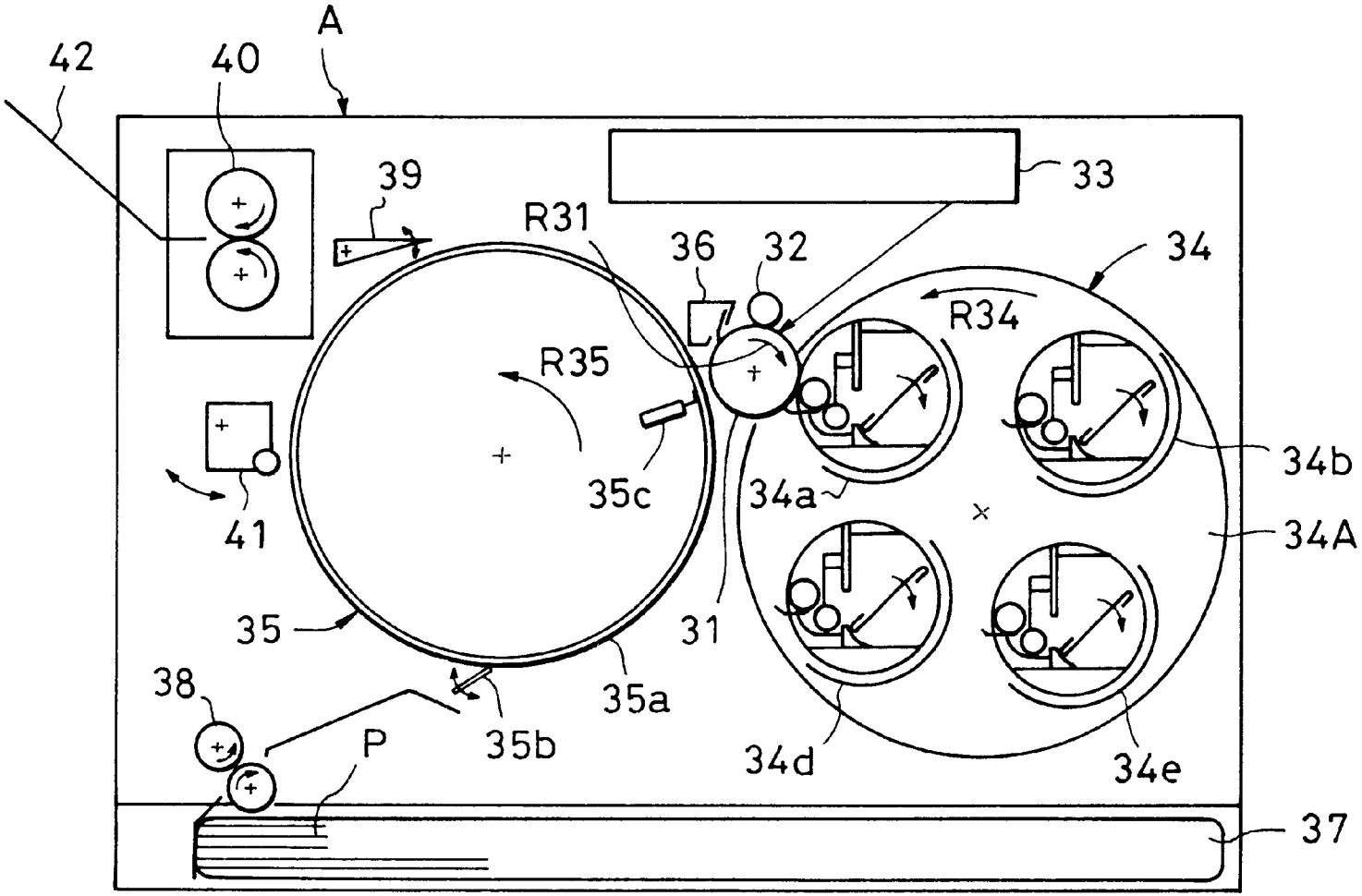
FIG. 6 is a longitudinal sectional view illustrating a schematic configuration of an image forming unit of a third embodiment of the invention.

FIG. 6 is a longitudinal sectional view illustrating a schematic configuration of an image forming apparatus provided with a fixing apparatus of a third embodiment of the invention. The image forming apparatus shown in FIG. 6 is a four-full-color laser beam printer capable of coping with A3/Ledger (legal) size (permitting image forming onto a copy medium of A3 size and Ledger (legal) size.

The schematic configuration of the entire image forming apparatus will be briefly described below with reference to FIG. 6.

A drum-shaped electrophotographic photosensitive body (hereinafter referred to as the "photosensitive drum") 31 serving as an image carrier is arranged substantially at the center in a main body A of the image forming apparatus. The photosensitive drum 31 is rotatably supported by the apparatus main body A, and is rotation-driven in the arrow 31 direction by driving means (not shown). A charging roller 32 arranged in contact to uniformly charge the photosensitive drum 31 surface, exposing means 33 forming an electrostatic latent image by irradiating a laser beam in response to image information onto the photosensitive drum 31 surface, a developing apparatus 34 developing by attaching a toner onto the electrostatic latent image into a toner image, a copy unit 35 copying a toner image on the photosensitive drum 31 onto a recording medium P, and a cleaning unit 36 removing the toner remaining after copying on the photosensitive drum 31 surface are arranged around the photosensitive drum 31 substantially sequentially in the rotating direction thereof.

The photosensitive drum 31 used in the third embodiment comprises an aluminum cylinder having a diameter of 40 mm, having an OPC (organic photosemiconductor) photosensitive layer provided on the peripheral surface thereof and is rotation-driven by the driving means in the arrow 31 direction at a process speed (circumferential speed) of 100 mm/sec.

The foregoing developing apparatus 34 has four-color developing units, including a yellow developing unit 34*a*, a magenta developing unit 34*b*, a cyan developing unit 34*c*, and a black developing unit 34*d* mounted on a rotating body 34A, and a developing unit subjected to developing is arranged at a developing position opposite to the photosensitive drum 31 by the rotation of the rotating body 34A in the arrow R34 direction (the yellow developing unit 34*a* is shown in FIG. 6).

The developing copy unit 35 has a copy drum 35*a* carrying on the surface thereof a recording medium P, formed into a cylindrical shape, a gripper 35*b* gripping the leading end of the recording medium P, and a copy charger 35*c*, arranged inside the copy drum 35*a* and copying a toner image on the photosensitive drum 31 onto the recording medium P on the copy drum 35*a*. The aforesaid copy drum 35*a*, in this embodiment, is formed by winding a PVDF sheet having a thickness of 200 $\mu$m onto a metal frame formed by connecting 156 mm-diameter ring-shaped members with rod-shaped members arranged at the both ends thereof, and rotates in the arrow R35 direction at substantially the same circumferential speed as the photosensitive drum 31.

A paper feed cassette 37 housing the recording medium P such as paper, and a paper feed roller 38 feeding the copy unit 35 by sending the recording medium P in the paper feed cassette 37 one by one are arranged at the bottom of the apparatus main body A.

A separating claw 39 for separating the recording medium P from the copy drum 35*a*, a fixing apparatus 40 for fixing the toner image on the recording medium P, and a drum cleaning unit 41 for cleaning the copy drum 35*a* surface, detachably arranged relative to the copy drum 35*a* are arranged at left top of the apparatus main body A in FIG. 6.

Now, operations of the image forming apparatus having the configuration as described above will be briefly described below.

When a print signal is issued by a printer controller (not shown), the photosensitive drum 31 is rotation-driven by the driving means in the arrow R31 direction at a process speed of 100 mm/sec. The surface of the photosensitive drum 31 thus rotation-driven is charged uniformly with a prescribed potential by the charging roller 32. Then a laser beam corresponding to image information from the exposing unit 33 is irradiated to remove electric charge of the irradiated portion, whereby an electrostatic latent image is formed on the photosensitive drum 31 surface. The electrostatic latent image on the photosensitive drum 31 is developed into a toner image through deposition of a yellow toner by the yellow developing unit 34*a* arranged by the rotation of the rotating body 34A at the developing position thereof.

On the other hand, the recording medium P is fed from the paper feed cassette 37 by the paper feed roller 38 to the copy drum 35*a* in synchronization with the rotation of the photosensitive drum 31. The recording medium P, of which the leading end is gripped by the gripper 35*b*, carried on the copy drum 35*a* surface by an attracting charger (not shown).

The yellow toner image formed on the foregoing photosensitive drum 31 surface is copied onto the recording medium P on the copy drum 35*a* by copy bias applied by the copy charger 35*c*. At the same time, the recording medium P is electrostatically attracted onto the copy drum 35 by charge injection at this point.

After removal of toner remaining on the surface without being copied onto the recording medium P on the copy drum 35*a* by the cleaning unit 36, the photosensitive drum 31 after copying of the toner image then serves to form a magenta image.

The image forming process comprising a series of steps of charging, exposure, development, copying and cleaning is similarly repeated for each of the remaining three colors of magenta, cyan and black, and toner images of four colors are piled up on the recording medium P. After copying of the toner images, the recording medium P is separated from the copy drum 35*a* surface by means of a separating charger (not shown), and the separating claw 39, heated and pressed by the fixing apparatus 40, and after fixing of unfixed toner images on the surface, discharged onto a paper discharge tray 42, thus completing a four-full-color image forming.

After separation of the recording medium P, deposits on the copy drum 35*a* surface are removed by a fur brush (drum cleaning unit), and the copy drum 35*a* is used for the following step of carrying the next recording medium P.

Now, the fixing apparatus 40 of the third embodiment, i.e., the fixing apparatus 40 for conducting oilless fixing and the toner used therein will be described below.

In this embodiment, the toner for achieving oilless fixing comprised a non-magnetic unitary fine particle polymerized toner, for example, prepared by the suspension polymerization method, which contains from 5 to 30 wt.% low-softening-point substance and has a shape factor SF1 (described later) within a range of from 100 to 120, a shape factor SF2 (described later) within a range of from 100 to 120, and a particle size within a range of from 5 to 7 $\mu$m, in substantially a spherical shape.

Figure 7:
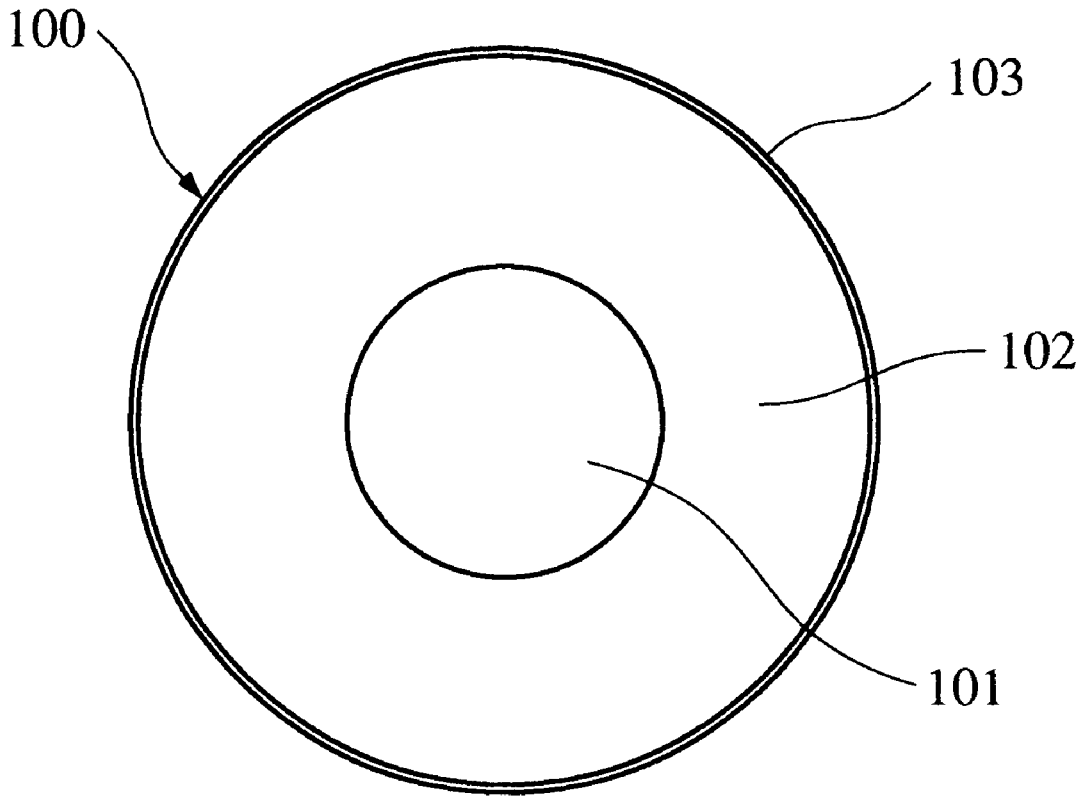
FIG. 7 is a longitudinal sectional view illustrating a configuration of a toner which a wax is internally involved.

A schematic configuration diagram of such a polymerized toner is illustrated in FIG. 7.

A shown in FIG. 7, the polymerized toner 100 takes a spherical shape because of the method of preparation. In FIG. 7, 101 is a core of the polymerized toner 100 containing an ester-based wax; 102 is a resin layer formed with styrene-butylarcylate; and 103 is a release layer formed with styrene-polyester. The polymerized toner 100 provided with the core 101, the resin layer 102 and the release layer 103 as described above has a specific gravity of about 1.05.

The polymerized toner 100 has a three-layer construction as described above because containing of the wax in the core 101 gives an offset preventing effect in the fixing step and provision of the resin layer 102 in the release layer 103 permit improvement of charging efficiency. In practical application, oil-treated silica is added for stabilization of electric charge of the toner.

An available method for manufacturing such a toner comprises uniformly dispersing a release agent, a coloring agent, a charge control agent and the like comprising a resin and a low-softening-point substance (wax) by means of a pressure neader, an extruder or a media disperser, causing the resultant mixture to hit a target mechanically or in a jet air flow to finely crush the same into a desired toner particle size, and sharpening the particle size distribution through a classifying step to prepare a toner, a method known as the crushing method.

Other applicable methods for manufacturing a toner include a method of atomizing a molten mixture in the air by the use of a disk or a multiple-fluid nozzle to obtain a spherical toner, disclosed in Japanese Patent Publication No. S56-13,945, methods for directly generating a toner by the use of the suspension polymerization method, and methods of manufacturing a toner by the use of the emulsifying polymerization method as typically represented by the soap-free polymerization method of directly generating a toner by the use of an aqueous organic solvent, into which a polymer is insoluble, solubly available in a monomer, as disclosed in Japanese Patent Publication No. S36-10,231, Japanese Unexamined Patent Publication No. S59-53,856,f and Japanese Unexamined Patent Publication No. S59-61,842.

In this embodiment, colored suspension particles having a weight average particle size of 7 μm is manufactured by using the suspension polymerization method under the atmospheric pressure or under a pressure capable of easily giving a fine-particle toner having a sharp particle size distribution and a particle size within a range of from 4 to 8 μm and using styrene and n-butylacrylate as monomers, a metal salicylate as a charge control agent, saturated polyester as a polar resin, and further a coloring agent.

The toner of the present embodiment is available through control of the toner particle size distribution and particle size accomplished by a method of altering the kind and the quantity of addition of a dispersant such as a hard-water-soluble inorganic salt or a substance having functions of protecting colloid, or by changing mechanical equipment conditions such as the roller circumferential speed, number of passes, shape of stirring blades and other stirring conditions, shape of the vessel, and the solid concentration in the aqueous solution.

Bonding resins applicable for the toner include styrene-(meta)acryl copolymer, polyester resin, epoxy resin, and styrene-butadiene copolymer commonly in use. In the method based on the polymerization method for directly obtaining a toner, any of the monomers thereof should preferably be used. More specifically, preferably applicable resins include styrene-based monomers such as styrene, o(m-, p-) methylstyrene, and m(p-)-ethylstyrene; ester (meta) acrylate-based monomers such as methyl (meta) acrylate, ethyl (meta) acrylate, propyl (meta) acrylate, butyl (meta) acrylate, acryl (meta) acrylate, dodecyl (meta) acrylate, stearyl (meta) acrylatle, behenyl (meta) acrylate, 2-ethylhexyl (meta) acrylate, dimethylaminoethyl (meta) acrylate, and diethylaminoethyl (meta) acrylate; ene-based monomers such as butadiene, isoprene, cyclohexane, (meta) acrylonitrile and amide acrylate.

Any of these resins is used alone, or more generally, in combination by appropriately mixing monomers so that the theoretical glass temperature (Tg) as described in the publication "Polymer Handbook", 2nd ed., III-p. 139–122 (John Wiley & Sons) exhibits 40 to 75° C. When the theoretical glass transition temperature is under 40° C., problems are posed in the pot stability of the toner and the duration stability of the developer. When this temperature is over 75° C., on the other hand, the fixing temperature increases, and particularly in the case of a full-color toner, mixing of the toners of the individual colors becomes insufficient, resulting in a poor reproducibility and further in a serious decrease in transparency of a transparent image. A theoretical glass transition temperature under 40° C. or over 75° C. is not therefore desirable in terms of a high-quality image.

The molecular weight of the bonding resin is measured by GPC (gel permeation chromatography). More specifically, the GPC measuring method comprises the steps of previously performing extraction of toner for 20 hours with a toluene solvent by means of a Soxley extractor, distillation-removing toluene with a rotary evaporator, adding an organic solvent which dissolves an ester-based wax but cannot dissolve the bonding resin, such as chloroform, sufficiently washing, and passing a sample obtained by filtering a solution thereof dissolved in THF (tetrahydrofuran) through a solvent-resistant membrane filter in a 150C made by Waters Co. with connected columns made by Showa Denko Co. A-801, 802, 803, 804, 805 and 807, thereby measuring a molecular weight distribution by means of the calibration curve of standard polystyrene resin.

The resultant resin components have a number average molecular weight (Mn) within a range of from 5,000 to 1,000,000, and a bonding resin presenting a ratio of the weight average molecular weight (Mw) to the number average molecular weight (Mn) (Mw/Mn) is preferable for the present embodiment. The molecular weight of the wax is smaller than the molecular weight of the bonding resin, as represented by a number average molecular weight (Mn) within a range of from several thousand to several tens of thousand.

Regarding the coloring agent used for the toner, on the other hand, the black coloring agent should be carbon black, a magnetic substance tone-adjusted into black by the use of yellow/magenta/cyan coloring agents.

Applicable yellow coloring agents include compounds typically represented by condensed azo compounds, isoindolinone compounds, anthraquinone compounds, azo-metal complexes, methyne compounds and arylamide compounds. More specifically, G.I. pigments yellow-12, 13, 14, 15, 17, 62, 74, 83, 93, 94, 95, 97, 109, 110, 111, 120, 127, 128, 129, 147, 168, 174, 176, 180, 181 and 191 can appropriately be used.

Applicable magenta coloring agents include condensed azo compounds, diketopyrroropyrol compounds, anthraquinone and quinacridone compounds, basic dye-rake compounds, naphthol compounds, benzimidazolone compounds, thioindigo compounds, and perylene compounds. More specifically, C.I. pigments red 2, 3, 5, 6, 7, 23, 48:2, 48:3, 48:4, 57:1, 81:1, 144, 146, 166, 169, 177, 184, 185, 202, 220, 221 and 254 are particularly preferable.

Applicable cyan coloring agents include copper phthalocyanine compounds and derivatives thereof, anthraquinone compounds, and basic dye-rake compounds. More specifically, C.I. pigments blue 1, 7, 15, 15:1, 15:2, 15:3, 15:4, 60, 62 and 66 can particularly suitably be used.

These coloring agents may be used alone or in mixture, or in a solid-solution state. The coloring agents in this embodiment are selected in view of color tone angle, color saturation, brightness, weather resistance, transmissivity, and dispersibility into toner. The amount of added coloring agent should be within a range of from 1 to 20 weight parts relative to 100 weight parts of resin.

When using a magnetic substance as a black coloring agent, the amount of addition should be within a range of from 40 to 150 weight parts relative to 100 weight parts of resin, unlike the other coloring agents.

Figure 8:
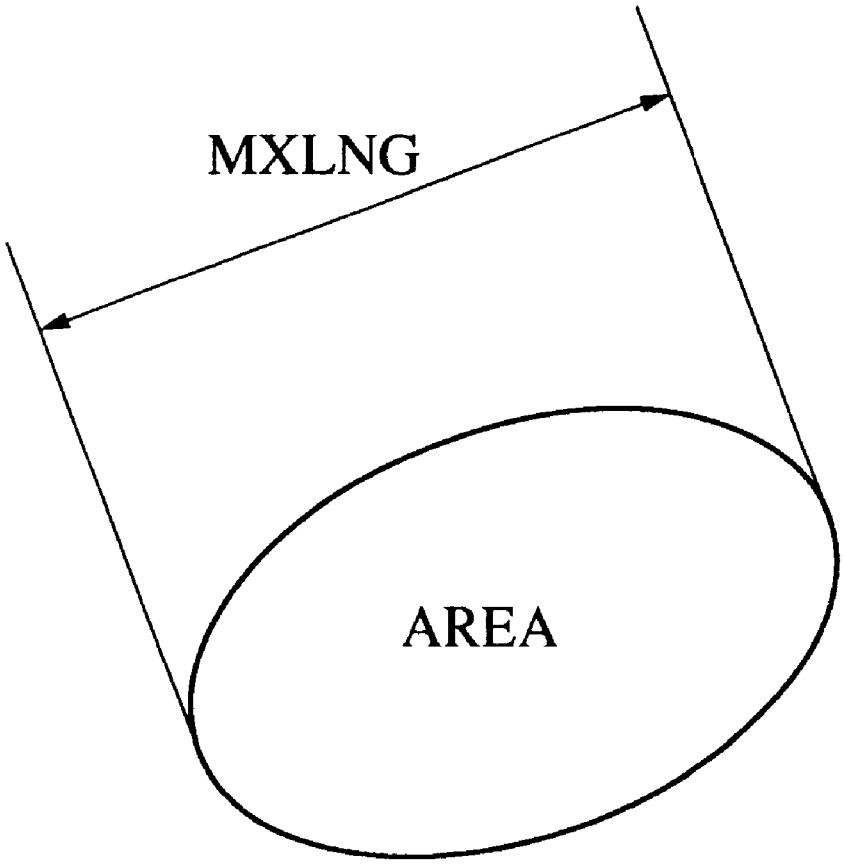
FIG. 8 is a descriptive view of a shape coefficient SF1.
Figure 9:
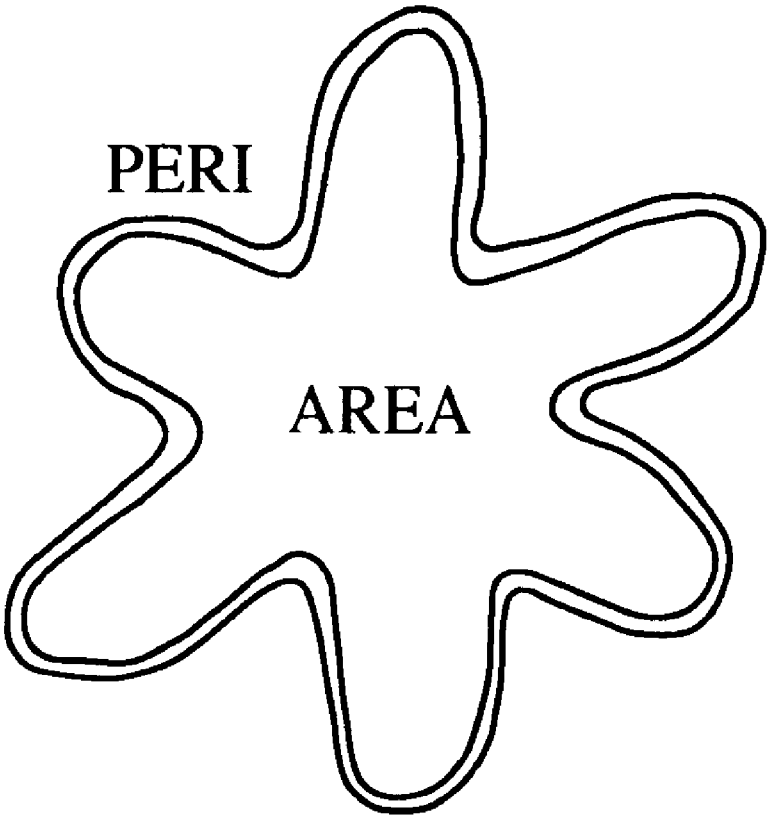
FIG. 9 is a descriptive view of a shape coefficient SF2.

Now, the shape factor SF1 and the shape factor SF2 will be described. The shape factor SF1 is a value representing roundness of the shape of a spherical material as shown in FIG. 8, which is a value obtained by dividing the square of the maximum length MXLNG of an ellipsoid-like shape formed by projecting a spherical object onto a two-dimensional plane by the area of the shape AREA, and then multiplying the quotient with 100 $\pi/4$.

That is, the shape factor SF1 is defined by the following formula:

$$SF1=\{(MXLNG)^2/AREA\}\times(100\ \pi/4)$$

The SF1 takes a lowest value of 100 when the spherical object is a true sphere, and the value becomes larger according as the shape becomes more flat.

The shape factor SF2 is a value expressing the ratio of convex or concave of the shape of a material, and is represented by a value determined by dividing a square of the circumferential length PERI of a shape formed by projecting an object onto a two-dimensional plane by the area of the shape AREA and multiplying the resultant quotient by $100/4\pi$.

That is, the shape factor SF2 is defined by the following formula:

$$SF2=\{(RERI)^2/AREA\}\times(100/4\pi)$$

The shape factor SF2 takes a lowest value of 100 when the sphere-like object is a true sphere, and becomes larger according as there are more convexes or concaves of the surface.

In this embodiment, an FE-SEM (S - 800) made by Hitachi Ltd. was employed: 100 toner images were sampled at random, and the image information was introduced through an interface into an image analyzer (LUSEX3) made by Nicole Co. for analysis and calculation based on the foregoing formula.

The aforesaid toner images were prepared with toners of the four colors including yellow, magenta, cyan and black, and incorporated into the image forming apparatus shown in FIG. 6 for image forming.

Indicators of grade of an image in a four-full-color image forming apparatus include the magnitude of a color reproducible range, and the extent of the degree of color saturation.

In this third embodiment, the quantity of toner on the recording medium P was optimized with a view to achieving satisfactory values of these indicators. The quantity of toner was expressed in unit of M/S [mg/cm$^2$] (toner weight per unit area) on the assumption of a uniform quantity of toner per unit weight.

The result suggest that a wide color reproducibility range and a high degree of color saturation are available by controlling the toner quantity on the recording medium P (M/S) within a range of from 0.6 to 0.7 mg/cm$^2$ for monochromes such as yellow, magenta and cyan, within a range of from 1.1 to 1.2 mg/cm$^2$ for secondary colors such as red, green and blue, and within a range of from 1.4 to 1.5 mg/cm$^2$ for black obtained from overlap of yellow, magenta and cyan. The foregoing M/S values, dependent on the content of coloring agents (pigments) contained in the toner, do not indicate absolute values.

In a color image forming apparatus such as a copying machine or a laser beam printer, concentration control is usually performed to control the color balance. This is to inhibit changes in the image concentration or the like caused by an environmental change or time change in toner or photosensitive drum.

The usually applied concentration control is known as a batch test, which comprises forming a batch of an arbitrary area on a photosensitive drum or a copy drum by altering such factors as developing bias, reading out an amount of reflected light by means of an optical sensor, and setting a value of developing bias so as to give an arbitrary target value. This batch test naturally gives errors, and the accuracy becomes higher according as effects affecting the results are fewer.

In the third embodiment, a batch test was carried out on the copy drum 10 since there was available no space for arranging a sensor around the photosensitive drum 31. As a result, there were effects of copying from the photosensitive drum 31, effects of primer of the copy drum 35*a* and effects of the attachment accuracy of the optical sensor, suggesting that the quantity of toner can deviate with a range of about ±15% on the maximum. With this error in view, therefore, a maximum toner quantity within a range of from 1.7 to 1.8 mg/cm$^2$ was set.

The range of weight of the recording medium P capable of being fed from the paper feed cassette 37 covers not only ordinary paper range of from 64 to 80 g/m$^2$, but also the paper weighing 105 g/m$^2$ as the strictest condition in the third embodiment of the invention.

The present inventors carried out studies toward achieving a fixing apparatus 40 capable of clearing the foregoing values, i.e., the maximum toner quantity of from 1.7 to 1.8 mg/cm$^2$ and the weight of the recording medium P of 105 g/m$^2$ as fixability performance of the fixing apparatus 40.

Figure 10:
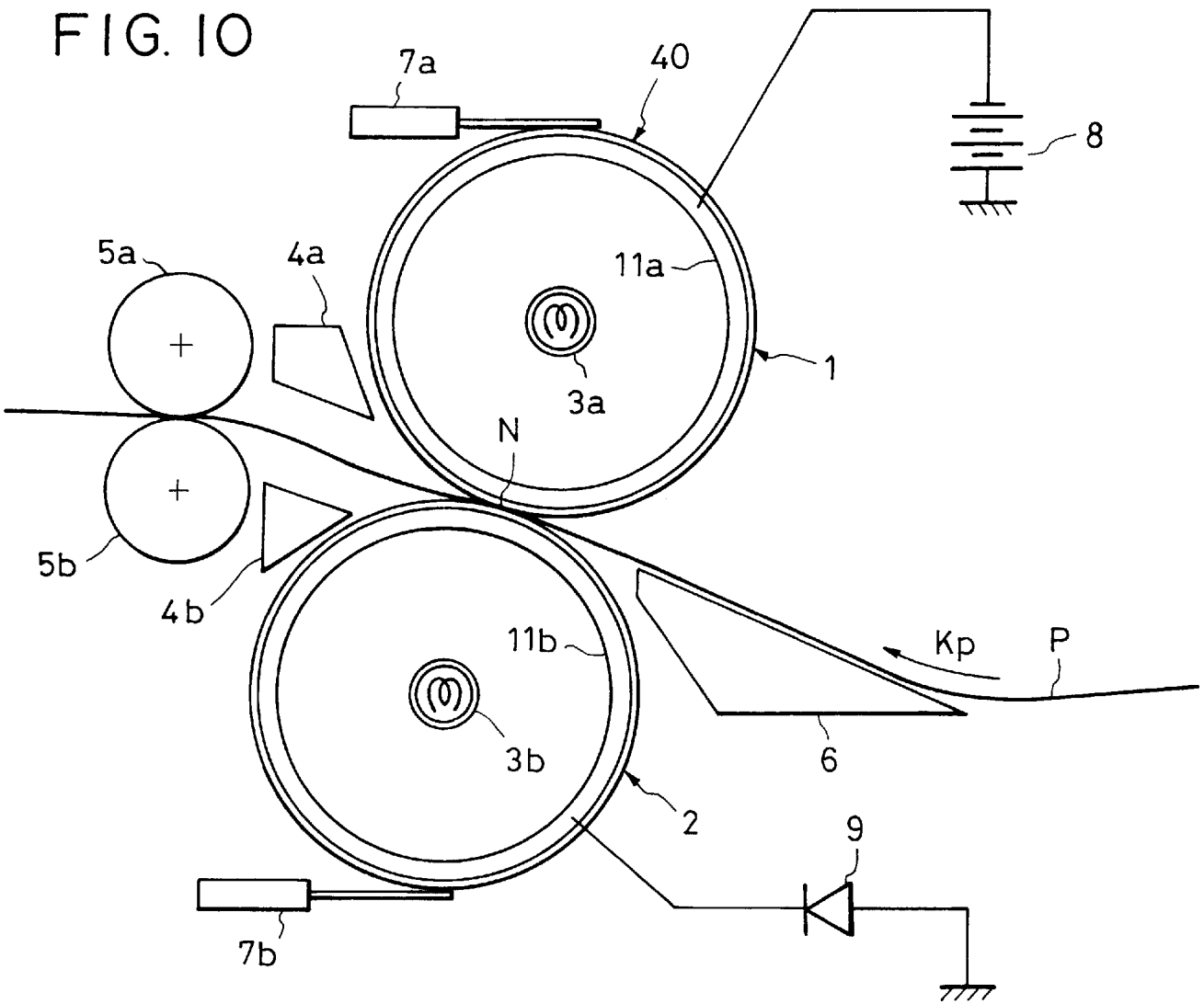
FIG. 10 is a longitudinal sectional view illustrating a schematic configuration of a fixing apparatus of the third embodiment of the invention.

FIG. 10 is a longitudinal sectional view illustrating a schematic configuration of the fixing apparatus 40 of the third embodiment of the invention. The same reference numerals as in FIG. 1 represent the same components.

In the fixing apparatus 40 shown in FIG. 10, a fixing roller (upper roller) 1 is arranged above, and a pressing roller (lower roller) 2 is arranged below: a fixing nip portion N is formed by bringing the both rollers 1 and 2 into pressure contact. The foregoing fixing roller 1 and the pressing roller 2 are not strictly different from each other in construction. In the following description, however, the roller in contact with an unfixed toner image on the recording medium P is referred to as the fixing roller 1, and the roller in contact with the back of the recording medium P, as the pressing roller 2. The two rollers are collectively called the fixing/pressing rollers. Details of the fixing/pressing rollers will be described later.

Heaters as heating members 3*a* and 3*b* are arranged in the fixing/pressing rollers, respectively, and thermistors 7*a* and 7*b* for temperature adjustment are arranged in contact with the surfaces thereof. Temperature of the fixing/pressing rollers is controlled by the thermistors 7*a* and 7*b*. Further, voltage of about −1 kV is applied to the core 11*a* by a power source 8 to prevent electrostatic offset on the fixing roller 1 side. On the other hand, a core 11*b* on the pressing roller 2 side is potential-controlled by a diode 9.

A recording medium P on which a toner image has been copied enters in the arrow Kp direction along an entry guide 6 toe fixing nip portion N. The recording medium P is heated and pressed by the fixing/pressing rollers at the fixing nip portion N, so that an unfixed toner image on the surface is melted and fixed. After fixing, the recording medium P is transferred along the guides 4*a* and 4*b* and discharged by discharge rollers 5*a* and 5*b* onto a paper discharge tray 42.

Figure 11:
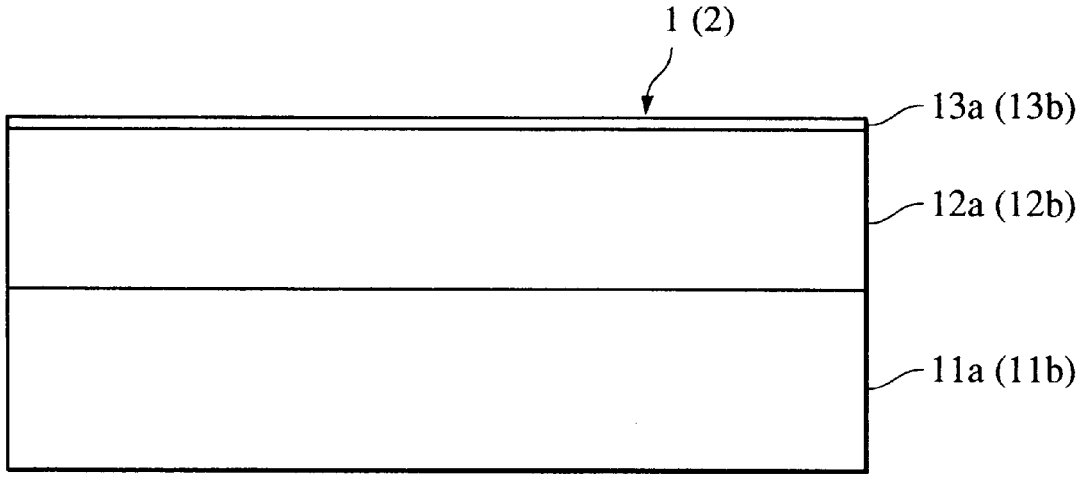
FIG. 11 is a partially enlarged view of a sectional surface of a fixing roller (pressing roller) of the third embodiment of the invention.

FIG. 11 is an enlarged view illustrating a part of a cross-section of the fixing roller 1. Because the pressing roller 2 has substantially the same configuration as that of the fixing roller 1, as described above, the description of the fixing roller 1 shall mutatis mutandis apply also to the pressing roller 2.

The fixing roller 1 has a layer structure provided with a cylindrical core 11*a*, an elastic body 12*a*, a primer layer, surrounding the outer periphery thereof, and a surface release layer 13*a* covering the surface of the elastic layer 12*a*, and is formed into a cylindrical shape as a whole. In the third embodiment, the core 11*a* is made of aluminum 6063A. The thickness of the core 11*a* has a direct effect on the warm-up time and strength at start of image forming: the warm-up time becomes longer according as the thickness is larger, and strength becomes lower according as the thickness becomes smaller. With these factors in view, the thickness should preferably be within a range of from 2.0 to 4.0 mm, although it also depends upon the diameter. In this embodiment, a thickness of 3.0 mm is adopted. The elastic body 12*a* is made of a rubber member comprising, for example, LTV-type (low-temperature vulcanization type) methyl-based or dimethyl-based silicone rubber. More specifically, silicone rubber (LTV-type) made by Shin-etsu kagaku Kogyo Co. is used. The surface release layer 13*a* comprises a PFA tube.

The present inventors confirmed fixability of the elastic bodies 12*a* and 12*b* (hereinafter referred to as the "rubber members" from time to time) with various values of hardness and thickness. Within a range of from 30 to 50 $\mu$m of the film thickness of the PFA tube forming the surface release layers 13*a* and 13*b*, no effect was exerted on flexibility. When considering durability and rejection ratio in manufacturing, a larger thickness of the surface release layer is more favorable. The thickness of the surface release layer 13*a* and 13*b* is fixed at 50 $\mu$m in the following description of the PFA tube.

Fixability varies also with the pressing force (contact pressure) of the fixing roller 1 and the pressing roller 2. In the study on fixability, confirmation was made with a pressing force as represented by the total pressure within a range of from 30 to 60 kgf. The result suggests that, with a higher rubber hardness, a higher pressing force leads to a better fixability, and a lower hardness of the elastic bodies 12*a* and 12*b* brings about a peak of a better fixability.

The fixing/pressing rollers made of rubbers with rubber hardness values of 15° and 8° exhibited a satisfactory fixability when the rollers were brought into contact under a pressing force of 60 kgf. With rubbers of rubber hardness (JIS-A Standard) values of 5° and 1°, fixability was the highest near 40 to 50 kgf. With 30 kgf, "toner blister" was caused by an insufficient pressing force, and with 60 kgf, "toner blister" occurred again. This is attributable to the fact that, because of the low rubber hardness, pressing caused the rubber member to leave the fixing nip portion N, so that the pressure was not uniformly applied onto the entire fixing nip portion N.

Then, fixability was studied with a pressing force of 60 kgf for the rubber members having rubber hardness (JIS-A Standard) values of 15° and 8°, and with a pressing force of 50 kgf for rubber members having rubber hardness (JIS-A Standard) values of 5° and 1°.

FIG. 12 illustrates the result of study on fixability carried out by forming the individual rubber members measured in JIS-A Standard hardness.

The fixing/pressing rollers having a diameter (outside diameter) of 60 mm have already been used for a fixing apparatus in a color copying machine and the like. When the diameter of the fixing/pressing rollers is set at 46 mm, an A3-size or an LEDGER-size (432 mm) recording medium P can pass through the fixing nip portion during the time the fixing/pressing rollers 2 rotates by three turns. The fixing/pressing rollers having a diameter of 40 mm has an outside diameter substantially equal to that of the fixing/pressing rollers of the oil coating type roller fixing unit in a laser printer for a conventional A-4 size and LETTER-size (maximum feed paper is LEGAL-size 355.6 mm).

Now, the conditions for the foregoing studies will be described below.

Fixing/pressing rollers having diameters of 60.0 mm, 46.0 mm, and 40.0 mm were prepared for a rubber hardness (JIS-A Standard) of 15° (pressing force: 60 kgf), a rubber hardness (JIS-A Standard) of 80 (pressing force: 50 kgf) and a rubber hardness (JIS-A Standard) of 1° (pressing force: 50 kgf), respectively, and were incorporated into image forming apparatuses to carry out fixing tests. Temperature was adjusted to 180° C. for all the fixing/pressing rollers, and light distribution was 120% for the both heaters 3*a* and 3*b* (dissipation of heat from the roller ends was compensated by changing the heater calorific value between the center and the end; the calorific value (measured from light emission) was set to 120% for the ends relative to 100% at the center). Heater wattage was 600 W for the upper heater 3*a* and 500 W for the lower heater 3*b*. The fed recording medium P of a weight and a kind of paper XEROX 4024, 105 g/m$^2$, LEDGER size was fed longitudinally.

The quantity of toner on the recording medium P and evaluation pattern were determined by forming three longitudinal bands having a width of 50 mm and a length of 420 mm along the recording medium transfer direction, one for each of the width center and the both ends of the recording medium P, which were adjusted to M/S 1.8 mg/cm$^2$.

The nip width of the fixing nip portion N was measured by printing a solid image in a pattern covering the entire length of the fixing/pressing rollers, fixing once the same, then introducing the same again into the fixing apparatus, and after stoppage for ten seconds, measuring the width at the center and the both ends (width in the recording medium transfer direction). The value shown as the nip width in FIG. 12 is for the center.

In FIG. 12, the mark "○" represents a satisfactory fixability (occurrence of "toner blister" not observed); "Δ" represents partial production of "toner blister"); and "x" represents a case in which "toner blister" occurs on most part.

To judge from the result shown in FIG. 12, a satisfactory fixability could be ensured without depending upon rubber hardness in the fixing apparatus 40 using the fixing/pressing rollers having a diameter of 60 mm. In the fixing apparatuses 40 using the fixing/pressing rollers having a diameter of 46 mm or 40 mm, dependency on rubber hardness is clearly observed. It is also suggested that, in these fixing apparatuses 40, fixability is largely improved by using a rubber having a rubber hardness not more than 5° (JIS-A Standard).

As is known from the result of this study, a high fixability can be ensured by the use of large-diameter fixing/pressing rollers. However, because this leads to an increase in the scale of the fixing apparatus 40 and to a longer warm-up time, this approach is not desirable for mounting on a compact image forming apparatus (for example, a compact laser printer).

Even with a rubber hardness not more than 5° (JIS-A Standard), "toner blister" was partially produced in the fixing apparatus 40 having 40 mm-diameter fixing/pressing rollers. "Toner blister" was produced near the trailing end of the recording medium P. This is attributable to the fact that, at the trailing end of the LEDGER-size paper, rotation of the fixing/pressing rollers reaches the fourth turn, thus resulting in a decrease in temperature of the fixing/pressing rollers.

In an image forming apparatus coping with an A3/LEDGER size, therefore, the diameter of the fixing/pressing rollers should preferably be such that the A3/LEDGER size paper finishes passage of the fixing nip portion during three turns of the fixing/pressing rollers, i.e., a diameter of about 46 mm (that is, the maximum size of feedable paper of the image forming apparatus is the LEDGER size).

FIG. 13 illustrates the result of confirmation of fixability for fixing/pressing rollers having a diameter of 46 mm using a rubber of a rubber hardness of 3° (JIS-A Standard) with various thicknesses. The relationship between the thickness of the fixing roller 1 and the thickness of the pressing roller 2 should always satisfy the following formula:

$$[\text{Fixing roller thickness}] \geqq [\text{Pressing roller thickness}]$$

because the discharging direction of the recording medium P from the fixing nip portion N should intentionally be directed downward. More specifically, the recording medium P passing through the fixing nip portion N is discharged toward the smaller thickness side. If the recording medium P is discharged in the reverse direction in terms of thickness, the recording medium P tends to be wound on the fixing roller 1 upon discharge, which should preferably be separated by the use of a separating claw or the like. In this case, the following problems are encountered, because the fixing roller is not a hard roller, but a soft one:

(1) The large thermal expansion of the rubber member leads to a low positional accuracy of the separating claw.

(2) The separating claw cutting into the rubber member damages the roller itself.

(3) The trace of the separating claw tends to appear in the color image formed on the recording medium P surface.

In the third embodiment, therefore, the foregoing relationship is established between the thickness of the fixing roller 1 and the thickness of the pressing roller 2 so that the recording medium P passing through the fixing nip portion N is discharged downward. Since the conditions of study in FIG. 13 are the same as those described previously, description thereof is omitted here.

As shown in FIG. 13, a high fixability is available when the nip width at the center becomes at least 8.0 mm. In order to ensure a nip width of at least 8.0 mm through combination of the fixing/pressing rollers having a diameter of 46 mm, the sum (total thickness) of the thickness of the fixing roller 1 and the thickness of the pressing roller 2 must be at least 4.0 mm.

A larger thickness of the rubber members of the fixing/pressing rollers leads to a larger nip width and hence to a higher fixability, but causes a demerit of a longer warm-up time for fixing temperature adjustment.

FIG. 13 illustrates also values of warm-up time from incorporation of the fixing/pressing rollers into the fixing apparatus 40 up to attainment of a standby temperature of the apparatus main body A (165° C. in this embodiment). As a result, the warm-up time can be shorter than five minutes (300 seconds) as a general standard only when the total thickness is not more than 5.0 mm (i.e., the thickness of one of the elastic layers should be not more than 2.5 mm). A larger total thickness leads to a longer period of time for temperature to reach the printing temperature from the standby temperature, thus resulting in a longer first printing time.

According to a study carried out by the present inventors, a combination of the fixing/pressing rollers having a total thickness of over 5.0 mm affected the first printing time. More specifically, there occurred a waiting time for increasing the fixing temperature from input of a printing signal up to entrance into the printing sequence.

In a combination of the fixing/pressing rollers having a total thickness not more than 5.0 mm, however, it is possible to enter the printing sequence immediately upon input of the printing signal, thus exerting no adverse effect on the first printing time.

When taking account of fixability and the warm-up time, the total thickness of the rubber members of the fixing/pressing rollers should preferably be not less than 4.0 and not more than 5.0 mm.

Figure 14:
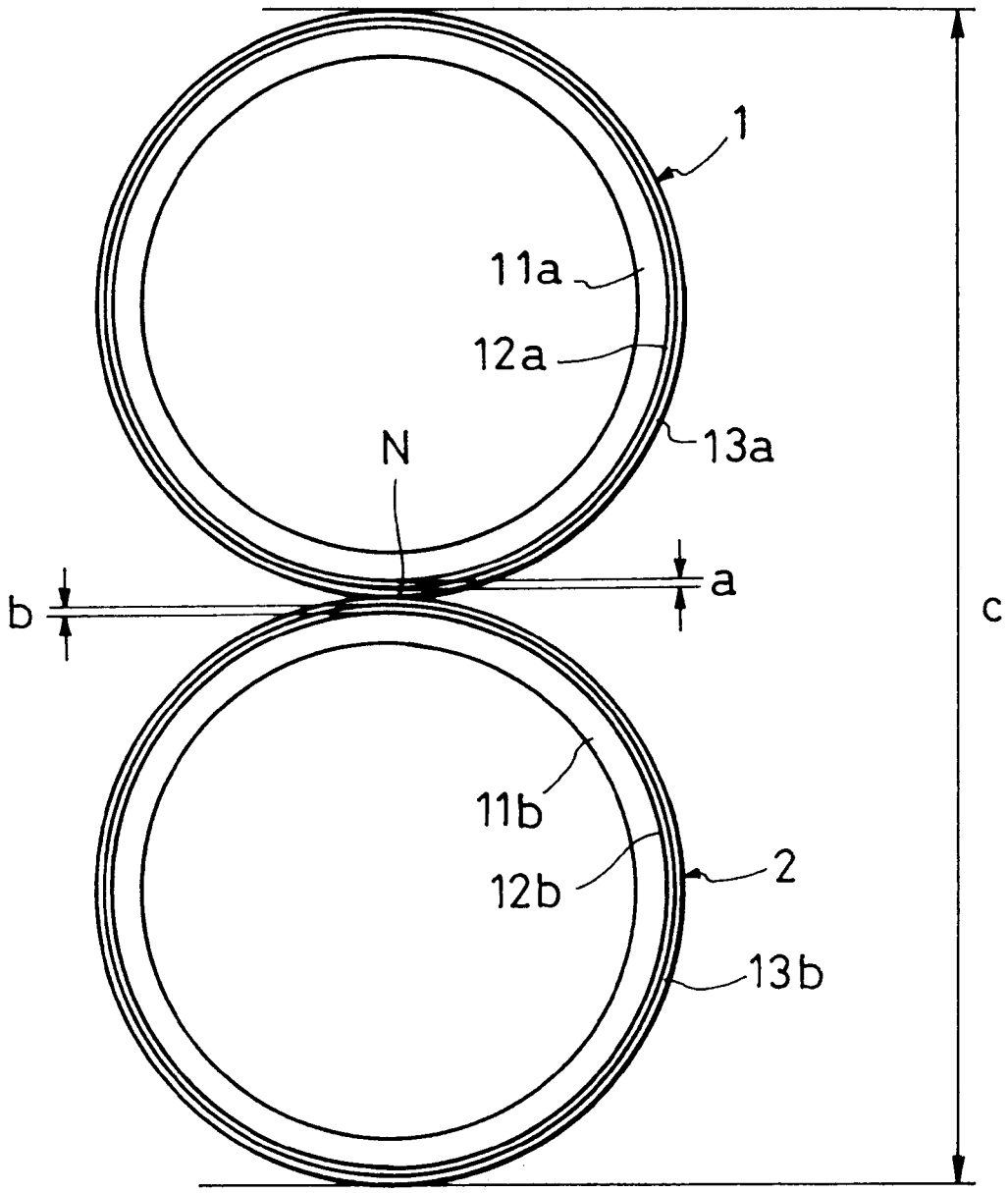
FIG. 14 is a descriptive view illustrating the ratio of the sum of the fixing/pressing roller diameters to the total thickness of the fixing nip portion.

FIG. 14 illustrates the relationship between the sum c of the diameter of the fixing roller 1 and the diameter of the pressing roller 2, on the one hand, and the sum of the thickness a of the rubber member (elastic body 12*a*) of the fixing roller 1 and the thickness b of the rubber member (elastic body 12*b*) of the pressing roller 2 at the fixing nip portion N, i.e., the total thickness (a+b), on the other hand. The foregoing range of the total thickness (a+b) of from 4.0 to 5.0 mm and the sum of diameters (c) of 92.0 mm satisfy the following formula:

$$0.040 \leqq (a+b)/c \leqq 0.055 \quad (1)$$

The thickness (50 m) of the surface release layers 13*a* and 13*b*, being very slight as compared with the thicknesses a and b, is disregarded.

An ordinary paper feed test of 150,000 sheets of paper (image forming apparatus) was carried out by incorporating a fixing roller 1 having a thickness of 2.5 mm and a pressing roller 2 having a thickness of 1.5 mm into the fixing apparatus shown in FIG. 10, which was attached to the image forming apparatus shown in FIG. 6.

As a result, there occurred no such problems as roller peeling and tube peeling, and a stable fixability was obtained for all runs from the first to 150,000th sheets.

In the third embodiment, the fixing roller 1 and the pressing roller 2 have the equal diameters (outside diameter ratio=1). However, even when altering the outside diameter ratio, the same effects as those described above are available by satisfying the foregoing relationship in the third embodiment of the invention, i.e., by using a ratio of the diameter of the fixing roller 1 to the diameter of the pressing roller 2 (outside diameter ratio) of 1, and adopting a sum of the fixing roller 1 thickness a and the pressing roller 2 thickness b of within a range of from 4.0 to 5.0 mm.

Fourth Embodiment

Figure 15:
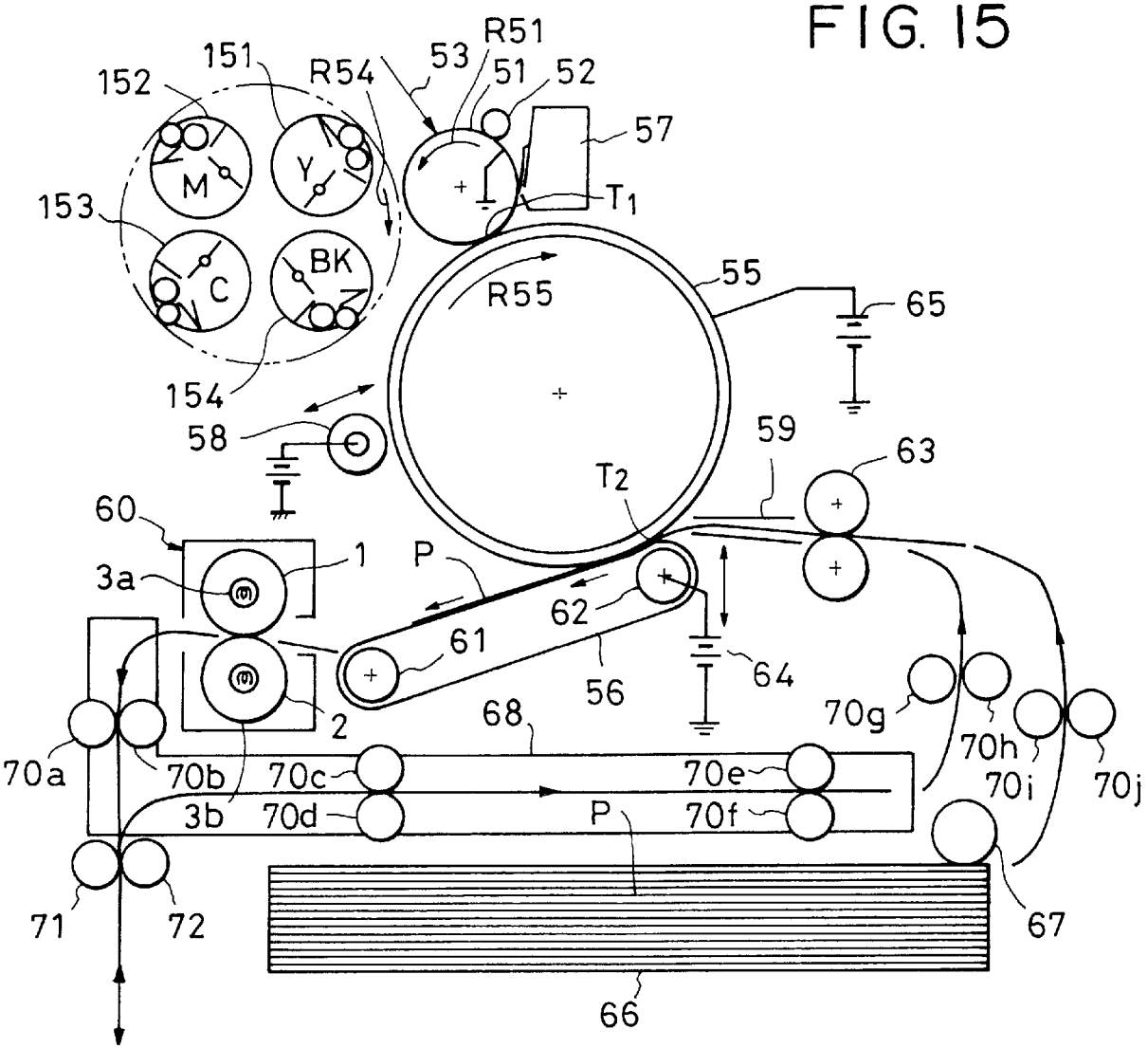
FIG. 15 is a longitudinal sectional view illustrating a schematic configuration of an image forming apparatus of a fourth embodiment of the invention.
Figure 18:
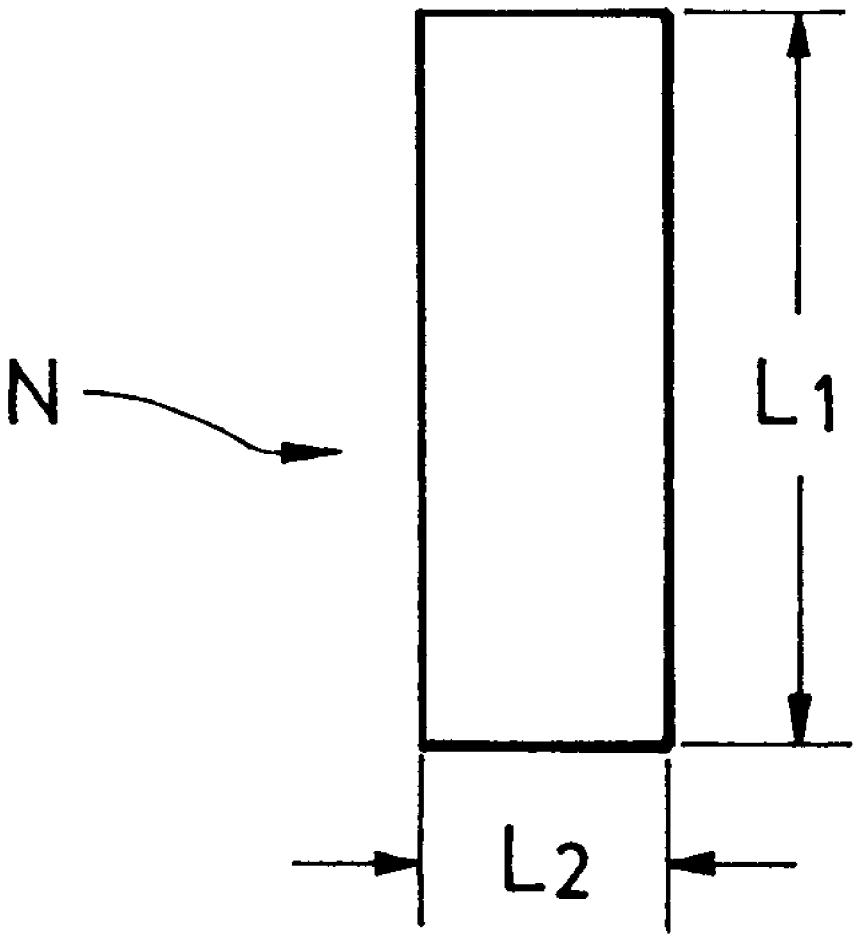
FIG. 18 is a plane view illustrating a pressure contact portion formed by the fixing roller and the pressing roller in the aforesaid fixing apparatus.
Figure 19:
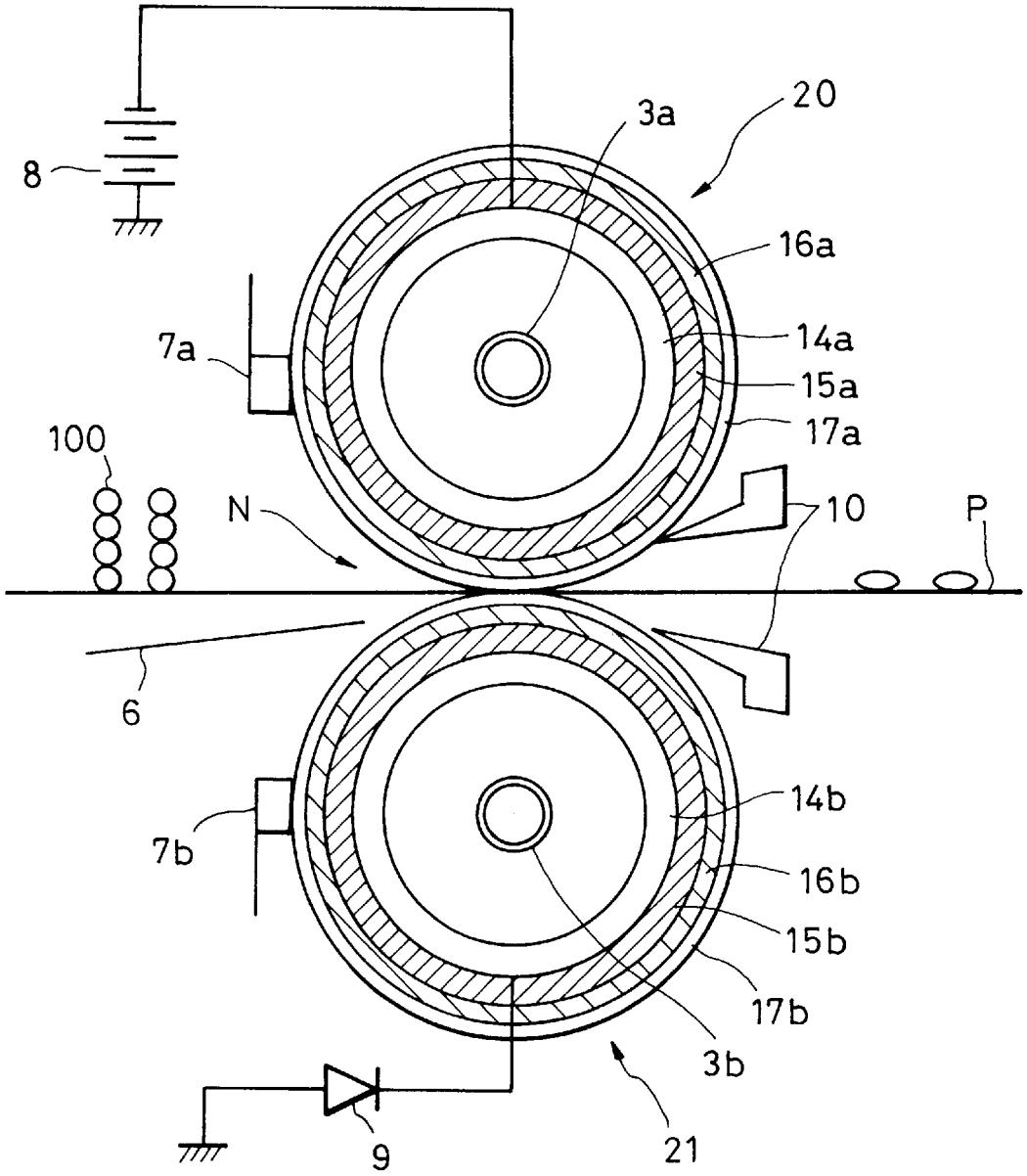
FIG. 19 illustrates a schematic configuration of a fixing apparatus of a seventh embodiment of the invention.
Figure 20:
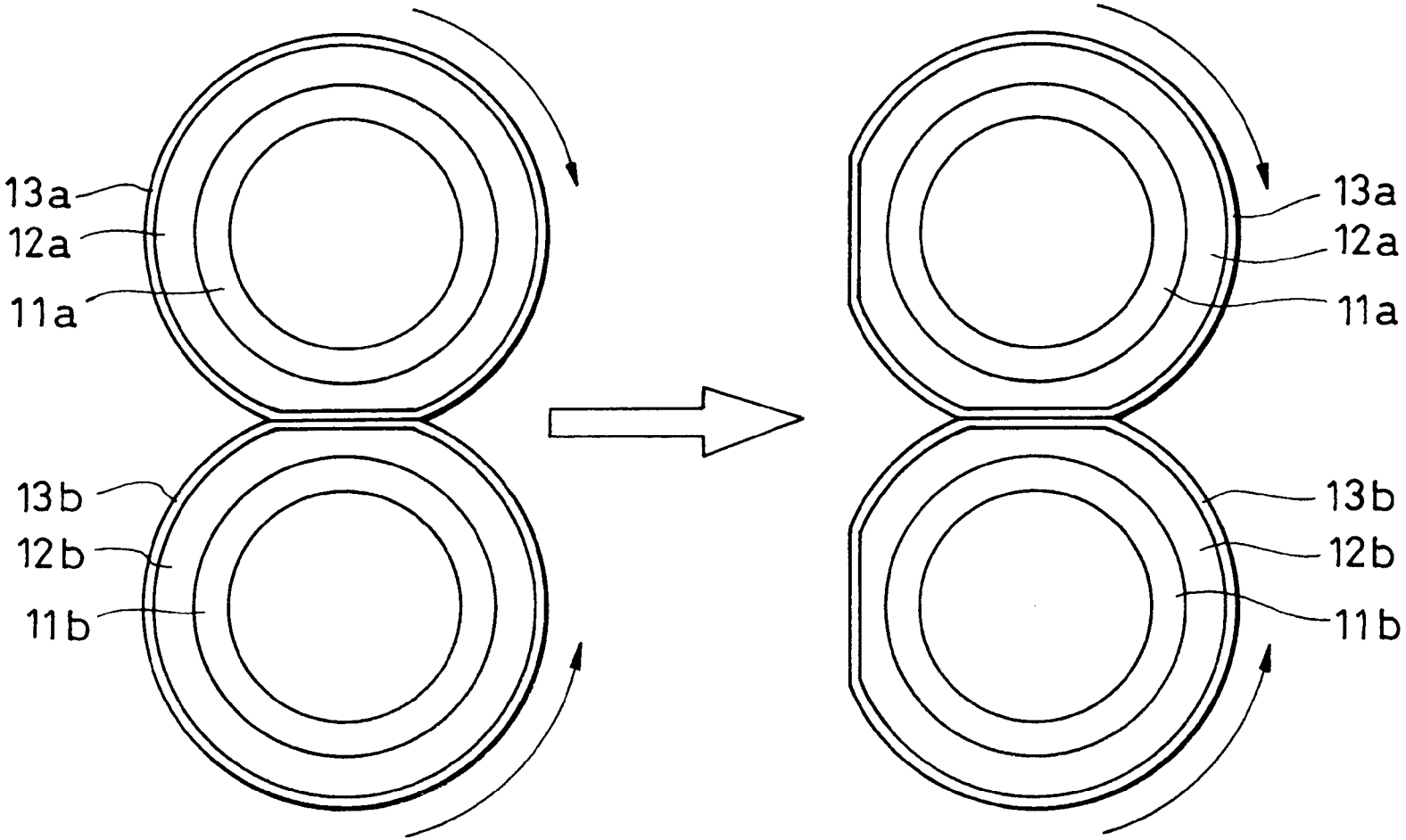
FIG. 20 is a descriptive view of plastic deformation of the roller.

FIG. 15 is a longitudinal sectional view illustrating a schematic configuration of an image forming apparatus of a fourth embodiment of the invention. The image forming apparatus shown in FIG. 15 is a four-full-color laser beam printer using a medium-resistance elastic roller as an intermediate copying body 55 and a copying belt (copying means) 56 as secondary contact-copying means.

In FIG. 15, 51 is a photosensitive drum repeatedly used as a first image carrier, which is rotation-driven at a prescribed process speed in the arrow 51 direction. The photosensitive drum 51 is uniformly charge-treated to a prescribed polarity and a prescribed potential by means of a primary charge roller 52 during the process of rotation, and an electrostatic latent image corresponding to a first component image (for example, a yellow component image) of a target color image is formed by being subjected to an image exposure 53 by a laser beam irradiated from image exposing means not shown.

Then, the aforesaid electrostatic latent image is developed by a yellow toner Y which is a first color in a first developing unit 151 (yellow developing unit). Individual developing units 151, 152, 153 and 154 (yellow, magenta, cyan and black) are rotated in the arrow R54 direction by driving means (not shown) and the developing unit to serve to develop the image is arranged at a developing position opposite to the surface of the photosensitive drum 51.

The intermediate copying body 55 is rotation-driven in the arrow R55 direction at the same process speed as the photosensitive drum 51. The foregoing yellow toner image formed and carried on the photosensitive drum 51 is subjected to a primary copying onto the outer peripheral surface of the intermediate copying body 55 under the effect of electric field and pressure formed by a primary copying bias applied by a primary power supply 65 onto the intermediate copying body 55 during passage through a primary copying nip section $T_1$ formed between the photosensitive drum 51 and the intermediate copying body 55. After primary copying, residual toner remaining on the photosensitive drum 51 surface is removed by a cleaning unit 57 to serve for forming a magenta toner image in the next step.

The image forming steps of primary charging, exposure, development, primary copying and cleaning are repeated sequentially for the remaining three colors including the second color magenta, the third color cyan and the fourth color black. A synthetic color toner image corresponding to the target color image in which the four color toners overlap is formed on the surface of the intermediate copying body 55.

Also in FIG. 15, 56 is a copying belt formed endlessly and is stretched between two bias roller (shaft) 62 and a tension roller (shaft) 61 arranged in parallel with the axis of the intermediate copying body 55. A prescribed secondary copying bias is applied onto the bias rollers 62 by a secondary power supply 64.

The primary copying bias from the photosensitive drum 51 to the intermediate copying body 55 for sequential overlap-copying of the first to fourth-color toner images has a polarity (+) reverse to that of the toner, and is applied from the primary power supply 65.

In the course of sequential copying of the first to fourth-color toner images from the photosensitive drum 51 to the intermediate copying body 55, the copying belt 56 and the intermediate copying body cleaning roller 58 are separable from the intermediate copying body 55.

Secondary copying of the synthetic color toner image overlap-copied onto the intermediate copying body 55 onto the recording medium P is accomplished as follows. When the copying belt 56 comes into contact with the intermediate copying body 55, the recording medium P is fed from a paper feed cassette 66 by a pickup roller 67, passes through a transfer rollers 70*i* and 70*j*, a resist roller 63, and pre-copying guide 59, is fed at a prescribed timing to a secondary copying nip section $T_2$ formed by the contact of the intermediate copying body 55 and the copying belt 56, and simultaneously, secondary copying bias is applied by a secondary power supply onto the bias roller 62. Secondary copying of the synthetic color toner image from the intermediate copying body 55 onto the recording medium P is accomplished by this secondary bias.

After completion of secondary copying, the recording medium P is transferred to the fixing apparatus 60, and heated under a pressure, whereby a toner image is fixed onto the surface. After completion of secondary copying, on the other hand, residual toner remaining from secondary copying on the surface of the intermediate copying body 55 is removed by the intermediate copying body cleaning roller 58.

In the case of ordinary one-side printing (image forming), the printing steps are completed by the aforesaid series of operations. Operations in the case of two-side printing will be described below.

In the case of two-side printing, the recording medium P after completion of one-side printing through the fixing apparatus 60 is transferred by the transfer rollers 70*a* and 70*b* to the two-side unit 68. The recording medium P is reversed through switching-back by reversal rollers 71 and 72, and transferred by transfer rollers 70*c* to 70*h* in the arrow direction. It is further fed via the resist roller 63 and the pre-copying guide 59 again to the secondary copying nip section $T_2$. Secondary copying of the toner image onto the second side surface of the recording medium P is therefore conducted with the end which was the trailing end upon printing of the first side surface as the leading end.

When the recording medium P having passed through the fixing apparatus 60 upon printing of the first side surface contains a large downward curl, the recording medium P after reversal for the printing of the second side surface would have a large upward curl, and during secondary copying, it comes in while following the intermediate copying body 55, thus tending to wind itself onto the intermediate copying body 55.

When an OHT (overhead projector transparency) is to be printed into a full-color image, furthermore, it is desirable to impart a larger calorific value than in feeding ordinary paper with a view to ensuring a high transparency. To achieve this object, in an image forming apparatus used in the fourth embodiment of the invention (laser beam printer), a paper feed speed (process speed) in fixing lower than that of ordinary paper is adopted.

In the fourth embodiment of the invention, the process speed for ordinary paper is 120 mm/sec, and is reduced to 30 mm/sec, a fourth the usual speed only when an OHT enters the fixing apparatus 60. In this case, the same fixing temperature as in ordinary paper is set. Since an OHT becomes too soft when a high temperature is applied at a low speed, it tends to easily wind itself around the pressing roller 2.

The fixing apparatus 60 forming a feature of the fourth embodiment will be described below in detail. The fixing apparatus 60 uses a fixing roller 1 and a pressing roller 2 having a diameter of 46 mm as in the foregoing third embodiment of the invention. The surface release layer 13 has a thickness of 50 $\mu$m, and the rubber layer 12 has a JIS-A Standard rubber hardness of 1°. A total pressing force 50 kgf was applied. Heater light distribution comprised 120% for both the upper and lower heaters 3*a* and 3*b*. Wattage comprised 600 W for the upper heater 3*a* and 500 W for the lower heater 3*b*.

FIG. 16 illustrates the result of study on the OHT paper feedability (OHT winding) and winding onto the intermediate copying body 55 caused by curling by fixing the thickness of the rubber members (elastic bodies 12*a* and 12*b*) of the fixing roller 1 and the pressing roller 2 to 4.0 mm in total. CG3300 made by 3M Co. was used as the OHT. Winding onto the intermediate copying body 55 was studied by the use of ordinary paper XEROX4024 weighing 75 g/m$^2$ in LETTER size.

As a result, when the elastic body 12*a* of the fixing roller 1 had a thickness of 2.5 mm and the elastic body 12*b* of the pressing roller 2 had a thickness of 1.5 mm, and when the elastic body 12*a* of the fixing roller 1 had a thickness of 2.4 mm and the elastic body 12*b* of the pressing roller 1 had a thickness of 1.6 mm, there occurred both OHT winding around the pressing roller 2 and winding around the intermediate copying body upon two-side copying of ordinary paper.

In contrast, when the elastic body 12*a* of the fixing roller 1 had a thickness of 2.3 mm and the elastic body 12*b* of the pressing roller 2 had a thickness of 1.7 mm, it was possible to prevent both OHT winding around the pressing roller 2 and winding around the intermediate copying body upon two-side copying of ordinary paper only if the thickness ratio thereof, i.e., the ratio of the fixing roller 1 thickness to the pressing roller 2 thickness was at least 0.74.

A paper feeding test (image forming) was carried out on 10,000 ordinary sheets of paper by incorporating a fixing roller 1 having a thickness of 2.3 mm and a pressing roller 2 having a thickness of 1.7 mm into the fixing apparatus 40 shown in FIG. 10, and attaching this fixing apparatus 40 into the image forming apparatus (laser beam printer) shown in FIG. 15. Kinds of fed paper included ordinary and OHT papers, and 10% of the ordinary paper were two-side fed.

As a result, OHT winding around the pressing roller 2 or winding around the intermediate copying body upon two-side printing of ordinary paper did not occur, giving a stable fixability.

A paper feeding test was carried out on 140,000 sheets of ordinary paper in usual one-side printing. The same performance as in the third embodiment was obtained with no such problems as tube peeling of the roller, and a stable fixability was available throughout the test.

Fifth Embodiment

The fifth embodiment of the invention relates to a fixing apparatus mounted on a color laser printer capable of copying on A4/LETTER size.

The schematic configuration is the same as that of the image forming apparatus shown in FIG. 10. Detailed description is therefore omitted here.

Both rubber members (elastic bodies 12*a* and 12*b*) of the fixing/pressing rollers have a thickness of 2.5 mm, and the rubber material is a silicone rubber having a JIS-A Standard hardness of 3°. The surface release layers 13*a* and 13*b* are composed of PFA tubes having a thickness of 50 $\mu$m.

The total pressure of pressing force of the fixing/pressing rollers was varied within a range of from 30 to 60 kgf. In this fifth embodiment also, the best fixability was obtained under a pressing force within a range of from 40 to 50 kgf. The fifth embodiment was carried out with a total pressure of 40 kgf.

The following paragraphs describe changes in fixability and OHT winding when changing the diameter of the fixing roller 1 and the pressing roller 2, thickness of the rubber members 12*a* and 12*b*, and the ratio of thickness.

In the case of an apparatus main body A capable of coping with A4/LETTER size, the maximum size is the LEGAL size (355 mm) in many cases. The fixing/pressing rollers should preferably have therefore a diameter permitting completion of fixing in three turns of the fixing/pressing rollers, i.e., 38 mm. In order to downsize the apparatus main body A, in contrast, a diameter not more than 45 mm is appropriate. In the fifth embodiment, therefore, fixing/pressing rollers having a diameter of 40 mm were employed.

The image forming apparatus used for study on fixability and OHT winding is a laser beam printer of the type shown in FIG. 6 described in the third embodiment.

FIG. 17 illustrates the result of study on fixability and OHT winding when altering the thickness and the thickness ratio of the fixing/pressing rollers having a diameter of 40 mm.

Both the fixing/pressing rollers have an adjusted temperature of 180° C., and heater light distribution comprises a temperature of 120° C. for both the fixing/pressing rollers. Wattage comprises 600 W for the upper heater 3*a* and 500 W for the lower heater 3*b*. The kind and weight of the fed recording medium P were XEROX4024 and 105 g/m$^2$ LEGAL size fed longitudinally.

The quantity of toner on the recording medium P and the evaluation pattern were determined by forming three longitudinal bands having a width of 30 mm and a length 40 mm at the width center and the both ends of the recording medium P, adjusted to M/S=1.8 mg/cm$^2$. OHT winding was studied, as in the third embodiment, by means of a CG3300 manufactured by 3M Co.

As shown in FIG. 17, in the fixing/pressing roller having a diameter of 40 mm, the total thickness of 3.0 mm is insufficient for the rubber members of these rollers, but a total thickness of at least 4.0 mm is necessary. As to OHT winding, it was confirmed that a thickness ratio (the ratio of the pressing roller 2 thickness to the fixing roller 1 thickness) of at least 0.74 could prevent occurrence of winding.

A paper feeding test was carried out on 10,000 sheets of paper by incorporating a fixing roller 1 having a thickness of 2.0 mm and a pressing roller 2 having a thickness of 1.5 mm into the fixing apparatus 40 used in the fifth embodiment of the invention, and attaching the same to the laser beam printer used in the third embodiment. The kind of fed recording medium P covered ordinary paper and OHT, and 10% of the ordinary paper were two-side-fed.

As a result, OHT winding around the pressing roller 2 did not occur, giving a stable fixability.

Thereafter, in usual one-side printing, a paper feed test of 140,000 sheets of paper was carried out. The same performance as in the foregoing third and fourth embodiments was achieved: no such problem as roller tube peeling was caused, and a stable fixability was available throughout the entire test.

In the third to fifth embodiments of the invention, as described above, with the thickness of the rubber layer of the roller and fixability in view, a roller using rubbers of various values of rubber hardness was studied. Among others, the roller using a rubber having a rubber hardness not more than 5° (JIS-A Standard) gives the same effect as in the foregoing first embodiment.

Now, sixth to eighth embodiments of the invention configured with a low gloss and a high fixability will be described below.

Sixth Embodiment

A fixing apparatus of a sixth embodiment of the invention has the same configuration as in the first embodiment. In a fixing roller 1 of this embodiment, an elastic layer 12*a* having a thickness of 2.0 mm is formed with an LTV-type dimethyl silicone rubber (having a JIS-A Standard rubber hardness within a range of from about 1° (9° in Asker C) to 30°) on an aluminum core 11*a*, and a surface release layer 13*a* of a thickness of 50 μm is formed thereon with a PFA tube. A roller material is appropriately selected and formed into a diameter of 40 mm so as to result in a roller surface hardness (roller peripheral hardness when the total load as measured with an Asker C hardness meter manufactured by Kobunshi Keiki Co. of 1 kg) of 50°, 60° or 70°. A methylphenyl-based silicone rubber may be used for forming the fixing roller 1.

On the other hand, a pressing roller 2 was formed by forming an elastic layer 12*b* having a thickness of 1.5 mm with an LTV-type silicone rubber (having a JIS-A Standard hardness within a range of from 1° to 30°) on an aluminum core 11*b*, forming thereon a release layer 13*b* with a PFA tube into a thickness of 50 μm, and appropriately selecting and forming a rubber material so as to give a roller surface hardness of 55°, 65° or 75°. A methylphenyl-based silicone rubber may be used for forming a pressing roller 2.

The fixing apparatus of this embodiment is, as in the first embodiment, to fix a multiple-color, multiple-layer or monoc hromatic unfixed developer image of a polymer toner onto a recording medium. The fixing temperature is 180° C. with a ripple of ±3° C., with a roller process speed within a range of from 110 to 120 mm/sec. The fixing apparatus can cope with A4 size.

An object of the invention is to achieve a low gloss for each color. The term "gloss" as used in the invention is defined by means of the JIS-Z 8741 method applicable when measuring mainly a mirror gloss of paper (hereinafter simply referred to as the "degree of gloss") as in the first embodiment.

In the fixing apparatus of the sixth embodiment, values of fixability and degree of gloss at various values of pressing force [kgf] when the fixing roller has a surface hardness of 50° (Asker C) and the pressing roller has a surface hardness of 55° (Asker C), and the relationship between the shorter side length L1 [mm] of a nip section N which is a pressure-contact portion formed the fixing roller 1 and the pressing roller 2, on the one hand, and the ratio of the pressing force to (L1×L2)[kgf/mm$^2$], on the other hand, are shown in Table 1. L2 is a longitudinal length of the nip section N shown in FIG. 17, taking a value of 225 mm for an A4 printer, and 310 mm for an A3 printer. L1×L2 represents the area of nip section N.

TABLE 1

| Pressing force [kgf] | Fixability | Gloss [%] | Nip [mm] | Pressing force/(Nip × length) [kgf/mm$^2$] |
|---|---|---|---|---|
| 20 | Δ | 10 | 9.0 | 0.010 |
| 30 | ○ | 13 | 10.0 | 0.013 |
| 40 | ○ | 16 | 11.0 | 0.016 |
| 50 | ○ | 18 | 12.0 | 0.019 |
| 60 | ○ | 22 | 12.4 | 0.022 |
| 70 | ○ | 25 | 12.6 | 0.025 |
| 80 | ○ | 30 | 12.7 | 0.028 |

○: Good; Δ: Fair; X: Poor

The results shown in Table 1 suggest that, with a surface hardness of the fixing roller of 50° and a surface hardness of the pressing roller of 55°, a pressing force within a range of from 20 to 70 [kgf] can satisfy the low gloss (up to 25%) and fixability (at least Δ).

When a surface hardness of the fixing roller of 60° and a surface hardness of the pressing roller 65°, fixability, gloss, short side length L1 [mm] of the nip section N, and pressing force/(L1×L2)[kgf/mm$^2$] are correlated under various values of pressing force [kgf] as shown in Table 2.

TABLE 2

| Pressing force [kgf] | Fixability | Gloss [%] | Nip [mm] | Pressing force/(Nip × length) [kgf/mm$^2$] |
|---|---|---|---|---|
| 20 | X | 12 | 7.8 | 0.011 |
| 25 | Δ | 15 | 8.0 | 0.014 |
| 30 | Δ | 18 | 8.5 | 0.016 |
| 40 | ○ | 22 | 9.5 | 0.020 |
| 50 | ○ | 25 | 9.8 | 0.024 |
| 60 | ○ | 30 | 10.0 | 0.027 |

○: Good; Δ: Fair; X: Poor

The results shown in Table 2 suggest that, with a surface hardness of the fixing roller 60° and a surface hardness of the pressing roller of 65°, a pressing force within a range of from 25 to 50 [kgf] can satisfy the low gloss (up to 25%) and fixability (at least Δ).

Table 3 shows the relationship among fixability, gloss, nip section N shorter side length L1 [mm], pressing force/(L1×L2)[kgf/mm$^2$] when altering the pressing force [kgf] with a fixing roller surface hardness of 70° and a pressing roller surface hardness of 75° in the fixing apparatus of the sixth embodiment.

TABLE 3

| Pressing force [kgf] | Fixability | Gloss [%] | Nip [mm] | Pressing force/(Nip × length) [kgf/mm$^2$] |
|---|---|---|---|---|
| 20 | X | 14 | 7.0 | 0.013 |
| 30 | X | 21 | 7.6 | 0.018 |
| 40 | X | 23 | 7.9 | 0.023 |
| 45 | Δ | 25 | 8.0 | 0.025 |
| 50 | Δ | 29 | 8.1 | 0.027 |
| 60 | ○ | 35 | 8.4 | 0.032 |

○: Good; Δ: Fair; X: Poor

The result shown in Table 3 suggests that, with a fixing roller surface hardness of 70° and a pressing roller surface hardness of 75°, a pressing force of 45 kgf can satisfy the low gloss (up to 25%) and the fixability (at least Δ).

Further, the results shown in Tables 1, 2 and 3 suggest that, in order to satisfy the low gloss, it is necessary to reduce the pressing force of the nip section N, and in order to satisfy the fixability, the shorter side length of the nip section N, L1 [mm], must be at least 8 [mm]. (That is, the lower limit value of pressing force for satisfying the fixability varies with the roller surface hardness.)

From the above, it is possible to satisfy the fixability and the low gloss by simultaneously satisfying the following two formulae:

$$\text{Pressure at the nip section}=[\text{Pressing force}]/(L1\times L2)[\text{kgf/mm}^2] \leqq 0.025 \quad (1)$$

$$\text{Nip section shorter side length } L1\ [\text{mm}] \geqq 8.0 \quad (2)$$

When the fixing roller surface hardness is larger than 70°, and the pressing roller surface hardness is larger than 70°, setting of L1=8 results in [pressing force]/(L1×L2)>0.025, and setting of {pressing force}=0.025 leads to L1<8. In the both cases, the degree of gloss becomes larger in spite of a satisfactory fixability. When the fixing roller surface hardness is larger than 70° and the pressing roller surface hardness is larger than 75°, as described above, the fixability requirement is satisfied although the nip is smaller than 8.0 [mm], because the high roller surface hardness leads to a large pressure acting on the nip section surface.

By satisfying simultaneously the foregoing two formulae, it is possible to obtain a uniformly low gloss in full-color image printing while ensuring fixability in monochrome image printing, even if the fixing apparatus is compact in size. It is thus possible to reduce the difference in gloss between the non-image portion and the image portion, and prevent the problem of characters difficult to read under the effect of reflection from a high gloss.

Seventh Embodiment

The seventh embodiment comprises the fixing apparatus of the sixth embodiment in which any of the fixing roller and the pressing roller has a coat softer than a tube for the surface release layer.

In the seventh embodiment, more specifically, the fixing roller 20 has an LTV-type elastic layer 15*a* (rubber of a JIS-A rubber hardness within a range of from 1° (7° in Asker C) to 30°) of a dimethyl silicone rubber formed in a thickness of 2.0 mm on an aluminum core 14*a*, and an intermediate layer 16*a* of fluorine rubber having a thickness of 50 μm formed thereon, and further, a surface release layer 17*a* formed thereon in a thickness of 15 μm by PFA coat (fluororesin coat), into a diameter of 40 mm. A methylphenyl-based silicone rubber may be used.

The pressing roller 21 has an LTV-type elastic layer 15*b* (a rubber having a JIS-A rubber hardness within a range of from 1° to 30°) of dimethyl silicone rubber formed in a thickness of 1.5 mm on an aluminum core 14*b*, an intermediate layer 16*b* of fluorine rubber formed thereon in a thickness of 50 μm, and further thereon a PFA coat serving as a highly releasable coat layer 17*b* having a thickness of 5 μm formed into a diameter of 40 mm. As rubber for the fixing roller 20 and the pressing roller 21, a methylphenyl-based silicone rubber may be used. In this apparatus, the fixing temperature is 180° C. with a ripple of ±3° C., with a roller process speed within a range of from 110 to 120 mm/sec. The fixing apparatus is for A4 size.

In a fixing apparatus in which the roller surface layer comprises a coat in place of a tube, when the fixing roller surface hardness is 60° and the pressing roller surface hardness is 65°, i.e., when the roller hardness is the same as in the first embodiment, fixabillity, gloss, nip section shorter side length L1 [mm], and pressing force/(L1×L2)[kgf/mm$^2$] are correlated as shown in Table 4 at various level of pressing force.

TABLE 4

| Pressing force [kgf] | Fixability | Gloss [%] | Nip [mm] | Pressing force/(Nip × length) [kgf/mm$^2$] |
|---|---|---|---|---|
| 20 | Δ | 12 | 8.2 | 0.011 |
| 30 | ○ | 16 | 9.2 | 0.014 |
| 40 | ○ | 20 | 10.0 | 0.018 |
| 50 | ○ | 22 | 10.6 | 0.021 |
| 60 | ○ | 25 | 10.8 | 0.025 |
| 70 | ○ | 29 | 10.9 | 0.029 |

○: Good; Δ: Fair; X: Poor

The result shown in Table 4 suggests that, with a fixing roller surface hardness of 60° and a pressing roller surface hardness of 65°, a pressing force within a range of from 20 to 60 [kgf] can satisfy the low gloss (up to 25%) and fixability (at least Δ). By converting the roller surface layer from tube to coat, it is possible to use the apparatus with a higher roller hardness as compared with the tube roller shown in Table 2, and to use a wide latitude of the pressing force.

As a result of detailed study on the tube surface layer of the sixth embodiment, the fixing roller surface hardness for satisfying simultaneously the foregoing low gloss and the fixability is up to about 60° (Asker-C), whereas it is up to about 65° in the coat of this embodiment.

With the same roller surface hardness, therefore, by replacing the surface layer of the roller from tube to coat, it is possible to provide a fixing apparatus having a lower gloss and a higher fixability. As the material for coat, FEP, PTFE or the like is also applicable in addition to PFA, and the fluorine rubber layer of the intermediate layer may be omitted.

Eighth Embodiment

This embodiment comprises the fixing apparatus of the sixth embodiment in which the surface layer of the roller is converted into a coat which is softer than the tube, using a higher rubber hardness accordingly, under conditions including [pressing force]/(L1×L2)[kgf/mm$^2$]≦0.025, and the nip section shorter side length L1 [mm]≧8.0. The fixing apparatus is substantially the same as in the seventh embodiment, so that the description thereof is omitted here.

In the eighth embodiment, the case of a roller surface hardness of 50° (Asker-C) was studied. With a roller surface hardness of 50°, and when the roller surface layer comprises a tube (see FIG. 1), the rubber of the surface layer rubber had a hardness of 1° (JIS-A Standard). When the surface layer of the roller is a coat (see FIG. 5), in contrast, it was possible to harden the base layer rubber hardness to 3° (JIS-A Standard) with a view to achieving the same roller surface hardness of 50°.

In a fixing apparatus provided with such rollers, the relationship among fixability, gloss, nip section shorter side length L1 [mm] and pressing force/(L1×L2)[kgf/mm$^2$] at various levels of pressing force [kgf] with a fixing roller surface hardness of 50° and a pressing roller surface hardness of 55° is shown in Table 5.

TABLE 5

| Pressing force [kgf] | Fixability | Gloss [%] | Nip [mm] | Pressing force/(Nip × length) [kgf/mm$^2$] |
|---|---|---|---|---|
| 20 | Δ | 9 | 9.1 | 0.010 |
| 30 | ○ | 12 | 10.1 | 0.013 |
| 40 | ○ | 14 | 11.0 | 0.016 |
| 50 | ○ | 16 | 12.0 | 0.019 |
| 60 | ○ | 20 | 12.4 | 0.022 |
| 70 | ○ | 22 | 12.6 | 0.025 |
| 80 | ○ | 27 | 12.7 | 0.028 |

○: Good; Δ: Fair; X: Poor

The result shown in Table 5 suggests that, with a fixing roller surface hardness of 50° and a pressing roller surface hardness of 55°, a pressing force within a range of from 20 to 70 [kgf] can satisfy the low gloss (up to 25) and the fixability (at least Δ), as in the case shown in Table 1.

Therefore, as in the sixth embodiment, pressing force/(L1×L2) [kgf/mm$^2$]≦0.025 and a nip section shorter side length L1 [mm]≧8.0 satisfy the low gloss (up to 25%) and fixability (at least Δ).

In a paper feed durability test, in the case of a fixing apparatus with tube as the roller surface layer and the base layer hardness of 1°, wrinkles and cracks of the roller occurred after printing 5,000 sheets of paper, and roller rubber was broken after printing of 10,000 sheets. In the case where the roller surface layer comprises a coat and the base layer has a rubber hardness of 3°, roller wrinkles, cracks and roller rubber breakage did not occur even after printing of 50,000 sheets, thus achieving a remarkable improvement as compared with the fixing apparatus with a roller surface layer comprising a tube and a base layer rubber hardness of 1°.

As described above, by changing the tube of the surface layer of the fixing apparatus into a soft coat, it is possible to increase the roller hardness of the base layer rubber. By increasing rubber strength, it is possible to avoid roller damage such as roller wrinkles, cracks and roller breakage, thus improving durability of the fixing apparatus.

As described above, rollers using rubbers of various values of hardness were studied in the sixth to eighth embodiments. Among others, for the roller using the rubber having a rubber hardness not more than 5° (JIS-A Standard), effects same to those in the foregoing first embodiment are available.

The embodiments of the invention have been described. However, the present invention is not limited by the foregoing embodiments in any manner, and it is possible to make various variants within the technical idea of the invention.

What is claimed is:

1. A fixing apparatus comprising:

a heating member;

a rotatable member having said heating member in the interior thereof and heating an unfixed toner on a recording medium; and a pressing member forming a nip with said rotatable member to hold said recording medium in between;

wherein said rotatable member comprises a core, an elastic layer provided on said core, and a thin surface layer provided on said elastic layer, and said elastic layer has a JIS-A Standard rubber hardness not more than 5 degrees and a thickness not more than 2.5 mm.

2. A fixing apparatus according to claim 1, wherein said thin surface layer has a thickness not more than 100 μm.

3. A fixing apparatus according to claim 1, wherein said thin surface layer is a release layer.

4. A fixing apparatus according to claim 1, wherein said elastic layer comprises silicone rubber.

5. A fixing apparatus according to claim 1, wherein said elastic layer comprises a rubber not plastically deforming.

6. A fixing apparatus according to claim 1, wherein said rotatable member is in contact with unfixed toner on the recording medium.

7. A fixing apparatus according to claim 6, wherein said rotatable member has a surface hardness as represented by an Asker C hardness not more than 65 degrees.

8. A fixing apparatus according to claim 1, wherein said pressing member is in contact with an unfixed toner on the recording medium.

9. A fixing apparatus according to claim 1, wherein said pressing member comprises an elastic layer, and said elastic layer of said pressing member has a JIS-A Standard hardness not more than 5 degrees.

10. A fixing apparatus according to claim 9, wherein said pressing member is a rotatable member having a surface hardness as represented by an Asker C hardness not more than 75 degrees and comprising said elastic layer near the surface thereof.

11. A fixing apparatus according to claim 1, wherein said pressing member comprises a core and an elastic layer provided thereon, and the sum of the thickness of the elastic layer of said rotatable member and the thickness of the elastic layer of said pressing member is not more than 5 mm.

12. A fixing apparatus according to claim 1, wherein said pressing member comprises a core and an elastic layer provided thereon, and the elastic layer of said pressing member has a thickness not less than 0.74 times the thickness of the elastic layer of said rotatable member.

13. A fixing apparatus according to any one of claims 9 and 12, wherein said pressing member has a release layer on the surface thereof.

14. A fixing apparatus comprising:

a heating member;

a rotatable member having said heating member in the interior thereof and heating an unfixed toner on a recording medium; and a pressing member forming a nip with said rotatable member to hold the recording medium in between;

wherein said rotatable member comprises a core and a surface elastic layer provided on said core, and said surface elastic layer has a JIS-A Standard rubber hardness not more than 5 degrees and a thickness not more than 2.5 mm.

15. A fixing apparatus according to claim 14, wherein said surface elastic layer comprises silicone rubber.

16. A fixing apparatus according to claim 14, wherein said surface elastic layer comprises a rubber not plastically deforming.

17. A fixing apparatus according to claim 14, wherein said rotatable member is in contact with an unfixed toner on the recording medium.

18. A fixing apparatus according to claim 17, wherein said rotatable member has a surface hardness as represented by an Asker C not more than 65 degrees.

19. A fixing apparatus according to claim 14, wherein said pressing member is in contact with an unfixed toner on the recording medium.

20. A fixing apparatus according to claim 14, wherein said pressing member comprises an elastic layer, and said elastic layer of said pressing member has a JIS-A Standard rubber hardness not more than 5 degrees.

21. A fixing apparatus according to claim 20, wherein said pressing member is a rotatable member having a surface hardness as represented by an Asker C not more than 75 degrees and comprising said elastic layer near the surface.

22. A fixing apparatus according to claim 14, wherein said pressing member comprises a core and an elastic layer provided thereon, and the sum of the thickness of the surface elastic layer of said rotatable member and the thickness of the elastic layer of said pressing member is within a range of from 4 mm to 5 mm.

23. A fixing apparatus according to claim 14, wherein said pressing member comprises a core and an elastic layer provided thereon, and the thickness of the elastic layer of said pressing member is not less than 0.74 times the thickness of the surface elastic layer of said rotatable member.

24. A fixing apparatus according to any one of claims 20 and 23, wherein said pressing member has a release layer on the surface thereof.

25. A fixing apparatus comprising:

a rotatable member which is in contact with an unfixed toner to fix the same onto a recording medium; and a pressing member forming a nip with said rotatable member to hold the recording medium;

wherein the area of said nip and the pressing force of said pressing member relative to said rotatable member satisfies the following conditional formula:

$$[\text{Pressing force}](\text{kgf})/[\text{nip area}](\text{mm}^2) \leqq 0.025\ (\text{kgf/mm}^2)$$

and said nip has a width not less than 8 mm.

26. A fixing apparatus according to claim 25, wherein said rotatable member has a tube layer on the surface thereof and has a surface hardness as represented by an Asker C not more than 60 degrees.

27. A fixing apparatus according to claim 25, wherein said rotatable member comprises a coat layer on the surface thereof, and has a surface hardness not more than 65 degrees.

28. A fixing rotatable member being provided with a heating member in the interior thereof comprising:

a core;

an elastic layer provided on said core; and a thin surface layer provided on said elastic layer;

wherein said elastic layer has a JIS-A Standard rubber hardness not more than 5 degrees and a thickness not more than 2.5 mm.

29. A fixing rotatable member according to claim 28, wherein said thin surface layer has a thickness not less than 10 $\mu$m and not more than 100 $\mu$m.

30. A fixing rotatable member according to claim 28, wherein said thin surface layer is a release layer.

31. A fixing rotatable member according to claim 28, wherein said elastic layer comprises silicone rubber.

32. A fixing rotatable member according to claim 28, wherein said elastic layer comprises a rubber not plastically deforming.

33. A fixing rotatable member according to claim 28, wherein said rotatable member has a surface hardness as represented by an Asker C not more than 65 degrees.

34. A fixing rotatable member being provided with a heating member in the interior thereof comprising:

a core; and a surface elastic layer provided on said core;

wherein said surface elastic layer has a JIS-A Standard rubber hardness not more than 5 degrees and a thickness not more than 2.5 mm.

35. A fixing rotatable member according to claim 34, wherein said surface elastic layer comprises silicone rubber.

36. A fixing rotatable member according to claim 34, wherein said surface elastic layer comprises a rubber not plastically deforming.

37. A fixing rotatable member according to claim 34, wherein said rotatable member has a surface hardness as represented by an Asker C not more than 65 degrees.

* * * * *

UNITED STATES PATENT AND TRADEMARK OFFICE

CERTIFICATE OF CORRECTION

PATENT NO. : 6,131,010

DATED : October 10, 2000

INVENTOR(S): TAKAO KUME, ET AL.

It is certified that error appears in the above-identified patent and that said Letters Patent is hereby corrected as shown below:

COLUMN 4:
Line 3, "has" should read --having--.

COLUMN 5:
Line 64, "a" (2nd occurrence) should read --an--.

COLUMN 11:
Line 29, "is" should read --are--; and
Line 64, "is" should read --are--.

COLUMN 13:
Line 22, "ing" should read --ingly--;
Line 37, "according" should read --accordingly--; and
Line 59, "suggest" should read --suggests--.

COLUMN 14:
Line 16, "according" should read --accordingly--; and
Line 45, "the both" should read --both--.

COLUMN 15:
Line 18, "according" should read --accordingly--; and
Line 19, "according" should read --accordingly--.

COLUMN 16:
Line 23, "the both" should read --both--; and
Line 36, "the both" should read --both--.

UNITED STATES PATENT AND TRADEMARK OFFICE

CERTIFICATE OF CORRECTION

PATENT NO. : 6,131,010

DATED : October 10, 2000

INVENTOR(S): TAKAO KUME, ET AL.

It is certified that error appears in the above-identified patent and that said Letters Patent is hereby corrected as shown below:

COLUMN 19:
Line 2, "means" should read --means,--;
Line 35, "roller (shaft)" should read --rollers (shafts)--; and
Line 57, "a" (1st occurrence) should be deleted.

COLUMN 20:
Line 56, "study" should read --the study--.

COLUMN 22:
Line 23, "the both" should read --both--.

COLUMN 23:
Line 39, "monoc" should be deleted; and
Line 53, "hromatic" should read --monochromatic--.

COLUMN 25:
Line 37, "the" should be deleted.

UNITED STATES PATENT AND TRADEMARK OFFICE

CERTIFICATE OF CORRECTION

PATENT NO. : 6,131,010

DATED : October 10, 2000

INVENTOR(S): TAKAO KUME, ET AL.

It is certified that error appears in the above-identified patent and that said Letters Patent is hereby corrected as shown below:

COLUMN 26:
Line 45, "level of" should read --levels of a--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*